US012723404B2

(12) United States Patent
Egan et al.

(10) Patent No.: US 12,723,404 B2
(45) **Date of Patent: *Sep. 1, 2026**

(54) CONNECTING MEMBERS AND SYSTEM FOR MODULAR WALL JUNCTIONS

(71) Applicant: FELLOWES, INC., Itasca, IL (US)

(72) Inventors: Michael Egan, Chicago, IL (US); Shawn M. Applegate, Streamwood, IL (US)

(73) Assignee: FELLOWES, INC., Itasca, IL (US)

( * ) Notice: Subject to any disclaimer, the term of this patent is extended or adjusted under 35 U.S.C. 154(b) by 141 days.

This patent is subject to a terminal disclaimer.

(21) Appl. No.: 18/766,606

(22) Filed: Jul. 8, 2024

(65) Prior Publication Data

US 2024/0360666 A1 Oct. 31, 2024

Related U.S. Application Data

(63) Continuation-in-part of application No. 18/127,617, filed on Mar. 28, 2023, now Pat. No. 12,607,010.
(Continued)

(51) Int. Cl.
*E04B 2/74* (2006.01)

(52) U.S. Cl.
CPC .... *E04B 2/7422* (2013.01); *E04B 2002/7462* (2013.01)

(58) Field of Classification Search
CPC .... E04B 2/7407; E04B 2/7422; E04B 2/7818; E04B 2/7854; E04B 2002/7462
(Continued)

(56) References Cited

U.S. PATENT DOCUMENTS 2,962,133 A * 11/1960 Kivett ..... F16B 5/0072 52/471
2,963,131 A * 12/1960 Brockway ..... E04B 2/7433 52/239
(Continued)

FOREIGN PATENT DOCUMENTS

CA 2591075 A1 12/2008
CA 2516083 C 3/2013
(Continued)

OTHER PUBLICATIONS

Non-final Office Action issued in related U.S. Appl. No. 18/127,617, dated Aug. 15, 2025.
(Continued)

*Primary Examiner* — James M Ference
(74) *Attorney, Agent, or Firm* — Cushman Partners LLC

(57) ABSTRACT

A system for interconnecting modular wall vertical frame members meeting at a corner junction comprises a first vertical frame member a second vertical frame member; and a connector member. Each vertical frame member has a mount for mounting a wall panel. Each vertical frame member has a pair of interlocking members positioned inwardly of the mount. The connector member has a body structure with a pair of legs with latches thereon extending therefrom. The legs with the latches extending to form a general V-shape. The legs with the latches are configured to be received in latch receiving spaces of the vertical frame members in a latching engagement to secure the vertical frame members in a corner junction relationship. The body structure of the connector member includes a head configured to be received between portions of the vertical frame members to support the corner junction relationship.

28 Claims, 15 Drawing Sheets

Related U.S. Application Data

(60) Provisional application No. 63/328,756, filed on Apr. 8, 2022.

(58) Field of Classification Search
USPC ..... 52/241
See application file for complete search history.

(56) References Cited

U.S. PATENT DOCUMENTS

| | | | | |
|---|---|---|---|---|
| 3,092,219 | A * | 6/1963 | Young | E04B 2/7854 52/775 |
| 3,193,061 | A * | 7/1965 | Downes | E04B 2/7854 52/772 |
| 3,292,328 | A | 12/1966 | Lewis et al. | |
| 3,371,454 | A * | 3/1968 | Anderson | E04B 2/766 52/775 |
| 3,475,870 | A * | 11/1969 | Birum, Jr. | E06B 1/12 52/211 |
| 3,585,771 | A | 6/1971 | Pinniger | |
| 3,590,542 | A | 7/1971 | Gallay | |
| 3,593,474 | A | 7/1971 | Neels | |
| 3,601,995 | A | 8/1971 | Seiz | |
| 3,671,063 | A | 6/1972 | Slayden | |
| 3,780,481 | A | 12/1973 | Tomkins | |
| 3,821,868 | A | 7/1974 | Edwards | |
| 3,848,382 | A | 11/1974 | Rensch | |
| 3,868,800 | A | 3/1975 | Peterson | |
| 3,869,867 | A | 3/1975 | Krings | |
| 3,909,059 | A | 9/1975 | Benninger | |
| 3,938,291 | A | 2/1976 | Criswell | |
| 4,016,688 | A | 4/1977 | Tiffin | |
| 4,065,904 | A * | 1/1978 | Taylor | E04B 2/7854 248/245 |
| 4,129,970 | A | 12/1978 | Whitney | |
| 4,129,973 | A | 12/1978 | Keller | |
| 4,318,636 | A | 3/1982 | Thomas | |
| 4,318,637 | A | 3/1982 | Oger | |
| 4,435,935 | A | 3/1984 | Larrea | |
| 4,449,346 | A | 5/1984 | Tremblay | |
| 4,455,801 | A | 6/1984 | Merritt | |
| 4,458,461 | A * | 7/1984 | Holley | E04B 2/7818 52/282.2 |
| 4,497,148 | A | 2/1985 | Lopez | |
| 4,570,402 | A | 2/1986 | Johnson | |
| 4,570,408 | A | 2/1986 | Frascaroli | |
| 4,585,131 | A * | 4/1986 | Crossman | A47B 96/1475 D25/123 |
| 4,667,450 | A | 5/1987 | Stefnik | |
| 4,827,682 | A | 5/1989 | Gildehaus | |
| 5,125,201 | A | 6/1992 | Pieters | |
| 5,233,803 | A * | 8/1993 | Bockmiller | E04B 2/825 52/774 |
| 5,393,114 | A | 2/1995 | Christensen | |
| 5,592,794 | A * | 1/1997 | Tundaun | E04B 1/6162 52/582.1 |
| 5,802,789 | A | 9/1998 | Goodman et al. | |
| 6,016,632 | A | 1/2000 | McGee | |
| 6,112,485 | A | 9/2000 | Beyer et al. | |
| 6,260,321 | B1 | 7/2001 | Rudduck | |
| 6,301,846 | B1 | 10/2001 | Waalkes et al. | |
| 6,418,671 | B1 | 7/2002 | DeRuiter et al. | |
| D477,090 | S | 7/2003 | Thomsen | |
| 6,591,557 | B1 | 7/2003 | Thomsen | |
| 6,688,056 | B2 | 2/2004 | Von Hoyningen Huene et al. | |
| 6,883,277 | B2 | 4/2005 | Wiechecki et al. | |
| 7,707,790 | B2 | 5/2010 | Williams | |
| 7,845,384 | B2 | 12/2010 | Goodman et al. | |
| 8,015,767 | B2 | 9/2011 | Glick et al. | |
| 8,024,901 | B2 | 9/2011 | Gosling et al. | |
| 8,327,805 | B2 | 12/2012 | Rogge | |
| 8,601,749 | B2 | 12/2013 | Von Hoyningen Huene et al. | |
| 8,925,619 | B2 | 1/2015 | Frezouls et al. | |
| 9,010,045 | B1 * | 4/2015 | Kopish | E04B 2/7435 52/506.06 |
| 9,074,372 | B2 | 7/2015 | Laurin | |
| 9,249,567 | B2 | 2/2016 | Yu et al. | |
| 9,284,729 | B2 | 3/2016 | Von Hoyningen Huene et al. | |
| 9,312,411 | B2 | 4/2016 | Laurin | |
| 9,546,483 | B2 | 1/2017 | Gosling et al. | |
| 9,562,356 | B2 | 2/2017 | Israeli | |
| 9,593,481 | B2 | 3/2017 | Gosling et al. | |
| 9,650,785 | B2 | 5/2017 | Yu et al. | |
| 9,803,361 | B2 | 10/2017 | Von Hoyningen Huene et al. | |
| 9,856,644 | B2 | 1/2018 | Gosling et al. | |
| RE46,929 | E | 7/2018 | Gosling et al. | |
| 10,094,400 | B2 | 10/2018 | Tamiozzo | |
| 10,202,762 | B2 | 2/2019 | Sollohub | |
| 10,301,821 | B2 | 5/2019 | Gosling et al. | |
| RE47,693 | E | 11/2019 | Gosling et al. | |
| 10,787,829 | B1 | 9/2020 | Meyer et al. | |
| 10,822,788 | B2 | 11/2020 | Knapp | |
| 10,920,418 | B2 | 2/2021 | Gosling et al. | |
| 10,927,545 | B2 | 2/2021 | Von Hoyningen Huene et al. | |
| 11,021,872 | B2 | 6/2021 | Gosling | |
| 11,085,184 | B2 | 8/2021 | Gosling et al. | |
| 11,371,280 | B2 | 6/2022 | Bernhagen | |
| 11,555,309 | B2 | 1/2023 | Kinnunen | |
| 11,584,041 | B2 | 2/2023 | Bernhagen | |
| 11,952,773 | B2 | 4/2024 | Gosling | |
| 12,410,611 | B2 * | 9/2025 | Applegate | E04B 2/7437 |
| 2001/0025463 | A1 | 10/2001 | Rudduck | |
| 2007/0039259 | A1 * | 2/2007 | MacDonald | E04B 2/7425 52/238.1 |
| 2008/0104922 | A1 * | 5/2008 | Glick | E04B 2/7425 52/630 |
| 2009/0109575 | A1 | 4/2009 | McCoy-Deedler | |
| 2021/0172168 | A1 | 6/2021 | Von Hoyningen Huene et al. | |
| 2021/0340772 | A1 | 11/2021 | Gosling et al. | |
| 2021/0386197 | A1 | 12/2021 | Merten | |
| 2022/0056688 | A1 * | 2/2022 | Gosling | E04B 2/7453 |
| 2023/0323662 | A1 * | 10/2023 | Egan | E04B 2/7407 52/241 |
| 2024/0360666 | A1 * | 10/2024 | Egan | E04B 2/7422 |

FOREIGN PATENT DOCUMENTS

| | | | |
|---|---|---|---|
| CN | 201074371 | Y | 6/2008 |
| CN | 202298987 | U | 7/2012 |
| CN | 210134604 | U | 3/2020 |
| CN | 112227621 | A | 1/2021 |
| CN | 113175153 | A | 7/2021 |
| CN | 215483658 | U | 1/2022 |
| CN | 216276295 | U | 4/2022 |
| CN | 114809511 | A | 7/2022 |
| CN | 217053761 | U | 7/2022 |
| DE | 20022989 | U1 | 10/2002 |
| DE | 202018103900 | U1 | 10/2018 |
| DE | 102017128311 | A1 | 5/2019 |
| EP | 0 146 409 | A2 | 6/1985 |
| FR | 2 453 304 | A1 | 10/1980 |
| GB | 2 042 670 | A | 9/1980 |
| GB | 2367569 | A | 4/2002 |
| GB | 2510750 | A | 8/2014 |
| WO | 2000024981 | A1 | 5/2000 |
| WO | 2007145882 | A2 | 12/2007 |
| WO | 2021119167 | A1 | 6/2021 |

OTHER PUBLICATIONS

International Search Report and Written Opinion issued in International Application No. PCT/US2023/016640, dated Jul. 10, 2023.

* cited by examiner

CONNECTING MEMBERS AND SYSTEM FOR MODULAR WALL JUNCTIONS

CROSS-REFERENCE TO RELATED APPLICATIONS

This application is a continuation in part and claims the benefit under 35 U.S.C. 120 of prior co-pending U.S. patent application Ser. No. 18/127,617, filed Mar. 28, 2023, which in turn claims the benefit under 35 U.S.C 119(e) of prior U.S. Provisional Patent Application Ser. No. 63/328,756, filed Apr. 8, 2022, each of which is herein incorporated by reference in its entirety. This application is also related to International Patent Application Publication No. PCT/US2023/016640, filed Mar. 28, 2023, which in turn claims the benefit under 35 U.S.C 119(e) of prior U.S. Provisional Patent Application Ser. No. 63/328,756, filed Apr. 8, 2022, each of which is herein incorporated by reference in its entirety.

FIELD

The present application relates to connecting members for securing vertical members of modular wall sections at junctions.

SUMMARY

One aspect of the application provides a system for interconnecting modular wall vertical frame members meeting at a corner junction. The system comprises a first vertical frame member and a second vertical frame member, each vertical frame member having a mount for mounting a wall panel. Each vertical frame member has a pair of lateral legs at the lateral edges thereof and a pair of inner legs extending inwardly. The inner legs are spaced laterally away from the lateral edges. Each vertical frame member also has a pair of interlocking members positioned inwardly of the mount. The interlocking members each have a laterally extending leg defining a laterally extending latch receiving space.

A connector member has a body structure with a head extending therefrom and a pair of legs with latches thereon extending therefrom opposite the head. The legs with the latches extending to form a general V-shape. The legs with the latches are configured to be received in the latch receiving spaces of the vertical frame members in a latching engagement to secure the vertical frame members in a corner junction relationship. The head is configured to be received between the inner legs and lateral legs of the vertical frame members to support the corner junction relationship.

Another aspect of the present application provides the connector member per se for interconnecting modular wall vertical frame members meeting at a corner junction.

Another aspect of the application provides a system for interconnecting modular wall vertical members meeting at an end-to-end junction. The system comprises a first vertical member and a second vertical member, at least one of the vertical members being a vertical frame member having a mount for mounting a wall panel. Each vertical member has a pair of lateral legs at the lateral edges thereof and a pair of inner legs extending inwardly, the inner legs being spaced laterally away from the lateral edges. Each vertical member also has a pair of interlocking members positioned inwardly of the inner legs. The interlocking members each have a laterally extending leg defining a laterally extending latch receiving space. A vertical fascia trim member is for covering a space formed between the vertical members. The fascia trim member has a pair of lateral legs at the lateral edges thereof and a pair of inner legs extending inwardly. The inner legs are spaced laterally away from the lateral edges. The fascia trim member also has a retainer member between the inner legs thereof.

A connector member has a body structure with a pair of legs with heads thereon extending therefrom and a fascia retainer member extending therefrom between the pair of legs. The legs with the heads extend to form a general V-shape. The connector member also has a pair of legs with latches thereon extending therefrom opposite the fascia retainer member. The legs with the latches are configured to be received in the latch receiving spaces of the vertical members in a latching engagement to secure the connector member to the vertical members. The fascia retainer member is configured to engage the retainer member of the fascia trim member in a latching engagement to secure the fascia trim member over the space formed between the vertical members. The heads are configured to be received between the inner legs and lateral legs of the vertical members and the fascia trim member to support the fascia trim member.

Another aspect of the present application provides the connector member per se for interconnecting modular wall vertical members.

Another aspect of the present application provides an installed modular wall system including any of the features discussed to form a junction.

Another aspect of the present application provided a covering for a terminal end portion of a wall section having a vertical frame member where a fascia trim member positioned as a vertical frame member adjacent the wall section frame member and a pair of fascia trim members are connected to create an end-to-end junction therebetween.

Another aspect of the present application provided a system for interconnecting modular wall vertical frame members meeting at a corner junction. The system comprises a first vertical frame member, a second vertical frame member, and a connector member. Each vertical frame member has a mount for mounting a wall panel. Each vertical frame member has a pair of lateral legs at the lateral edges thereof and a pair of inner legs extending inwardly. The inner legs may be spaced laterally away from the lateral edges. Each vertical frame member also has a pair of interlocking members positioned inwardly of the inner legs. The interlocking members each have a laterally extending leg defining a laterally extending latch receiving space. The connector member has a body structure with a head extending therefrom and a pair of legs with latches thereon extending therefrom opposite the head. The legs with the latches extend to form a general V-shape. The legs with the latches are configured to be received in the latch receiving spaces of the vertical frame members in a latching engagement to secure the vertical frame members in a corner junction relationship. The head is configured to be received between the inner legs and lateral legs of the vertical frame members to support the corner junction relationship.

The mount for mounting the wall panel may be in the form of at least one channel configured to receive a glass panel wall section therein. The at least one channel may include smaller channels that are configured to receive a gasket to seal the glass panel wall section.

The wall panel may include a single pane glass panel wall section. One of the first vertical frame member and the second vertical frame member may include a central section with the mount in the form of a channel for mounting the single pane glass panel wall section and with a gasket channel for receiving a gasket to seal the glass panel wall section.

The wall panel may include a double pane glass panel wall section. One of the first vertical frame member and the second vertical frame member may include a central section with the mount in the form of two channels, each channel for mounting a respective glass panel wall section, and with two gasket channels for receiving a gasket to seal the glass panel wall sections.

One of the first vertical frame member and the second vertical frame member may be configured for a wall having its own internal frame with a vertical frame member. One of the first vertical frame member and the second vertical frame member may include a main body with a member serving as the mount. The main body may include a longer supporting wall and a shorter supporting wall to support sections of the member.

For each vertical frame member, the laterally extending leg may be spaced from an inner wall of the respective vertical frame member and is connected thereto at one end and has an opposing end free for enabling insertion of the leg with the latch of the connector member into the latch receiving space of the respective vertical frame member. The laterally extending leg may be positioned inwardly of the inner leg so that the insertion of the leg with the latch of the connector member into the latch receiving space of the vertical frame member takes place without interference from the inner leg.

The laterally extending leg may include undulating configuration features, detent features, snap-fit features, press fit features and/or interference fit features on the surface inside the latch receiving space of the vertical frame member. The features are used for the latching engagement to secure the vertical frame members in the corner junction relationship.

The head of the connector member may help support the corner junction relationship by maintaining proper distance between the lateral leg of each vertical frame member and the opposing inner leg of the other vertical frame member, this may also help prevent the lateral leg from being deformed inwardly in the event it receives force against it after modular wall is erected.

The latch of the connector member may include a free leg that has resiliency with an outer surface matching an inner surface of the laterally extending leg of the interlocking member to create the latching engagement. The latch of the connector member may include undulating configuration features, detent features, snap-fit features, press fit features and/or interference fit features.

The connector member may be a molded integral piece including the body structure with the head and the pair of legs with the latches.

Another aspect of the present application provided a connector member for interconnecting modular wall vertical frame members meeting at a corner junction. The vertical frame members each having a mount for mounting a wall panel, a pair of lateral legs at the lateral edges thereof and a pair of inner legs extending inwardly. The inner legs may be spaced laterally away from the lateral edges. Each vertical frame member also has a pair of interlocking members positioned inwardly of the inner legs. The interlocking members each have a laterally extending leg defining a laterally extending latch receiving space. The connector member comprises a body structure, a head extending from the body structure, and a pair of legs with latches thereon extending from the body structure opposite the head. The legs with the latches extend to form a general V-shape. The legs with the latches are configured to be received in the latch receiving spaces of the vertical frame members in a latching engagement to secure the vertical frame members in a corner junction relationship. The head is configured to be received between the inner legs and lateral legs of the vertical frame members to support the corner junction relationship.

The connector member may be a molded integral piece including the body structure with the head and the pair of legs with the latches.

Another aspect of the present application provided system for interconnecting modular wall vertical members meeting at an end-to-end junction. The system comprises a first vertical member, a second vertical frame member, at least one of the vertical members being a vertical frame member having a mount for mounting a wall panel, a vertical fascia trim member, and a connector member. Each vertical member has a pair of lateral legs at the lateral edges thereof and a pair of inner legs extending inwardly. The inner legs may be spaced laterally away from the lateral edges. Each vertical member also has a pair of interlocking members positioned inwardly of the inner legs. The interlocking members each have a laterally extending leg defining a laterally extending latch receiving space. The vertical fascia trim member is configured for covering a space formed between the vertical members. The vertical fascia trim member has a pair of lateral legs at the lateral edges thereof of and a pair of inner legs extending inwardly. The inner legs is spaced laterally away from the lateral edges. The vertical fascia trim member also has a retainer member between the inner legs thereof. The connector member has a body structure with a pair of legs with heads thereon extending therefrom and a fascia retainer member extending therefrom between the pair of legs. The legs with the heads extending to form a general V-shape. The connector member also has a pair of legs with latches thereon extending therefrom opposite the fascia retainer member. The legs with the latches are configured to be received in the latch receiving spaces of the vertical members in a latching engagement to secure the connector member to the vertical members. The fascia retainer member is configured to engage the retainer member of the fascia trim member in a latching engagement to secure the fascia trim member over the space formed between the vertical members. The heads are configured to be received between the inner legs and lateral legs of the vertical members and the fascia trim member to support the fascia trim member.

The mount for mounting the wall panel may be in the form of at least one channel configured to receive a glass panel wall section therein. The at least one channel may include smaller channels that are configured to receive a gasket to seal the glass panel wall section.

The wall panel may include a single pane glass panel wall section. The at least one of the vertical frame members may include a central section with the mount in the form of a channel for mounting the single pane glass panel wall section and with a gasket channel for receiving a gasket to seal the glass panel wall section.

The wall panel may include a double pane glass panel wall section. The at least one of the vertical frame members may include a central section with the mount in the form of two channels, each channel for mounting a respective glass panel wall section, and with two gasket channels for receiving a gasket to seal the glass panel wall sections.

The fascia trim member may include a flat exterior wall extending between the lateral edges. The retainer member of the fascia trim member may have an inwardly projecting member extending inwardly from the wall and a head on the free end thereof. The head may be enlarged to provide for the latching engagement with the connector member.

The connector member may be a molded integral piece including the body structure with the pair of legs with heads thereon, the fascia retainer member, and the pair of legs with the latches thereon.

Another aspect of the present application provided a connector member for interconnecting modular wall vertical members meeting at an end-to-end junction with a fascia trim member therebetween, at least one of vertical members being a vertical frame member having a mount for mounting a wall panel, a pair of lateral legs at the lateral edges thereof of and a pair of inner legs extending inwardly. The inner legs may be spaced laterally away from the lateral edges. Each vertical member also has a pair of interlocking members positioned inwardly of the inner legs. The interlocking members each have a laterally extending leg defining a laterally extending latch receiving space. The fascia trim member for covering a space formed between the vertical members. The fascia trim member has a pair of lateral legs at the lateral edges thereof of and a pair of inner legs extending inwardly, the inner legs being spaced laterally away from the lateral edges, the vertical fascia trim member also having a retainer member between the inner legs thereof. The connector member comprises a body structure, a pair of legs with heads thereon extending from the body structure, a fascia retainer member extending from the body structure between the pair of legs, and the legs with the heads extending to form a general V-shape, and a pair of legs with latches thereon extending from the body structure opposite the fascia retainer member. The legs with the latches are configured to be received in the latch receiving spaces of the vertical members in a latching engagement to secure the connector member to the vertical members. The fascia retainer member is configured to engage the retainer member of the fascia trim member in a latching engagement to secure the fascia trim member over the space formed between the vertical members. The heads are configured to be received between the inner legs and lateral legs of the vertical members and the fascia trim member to support the fascia trim member.

The connector member may be a molded integral piece including the body structure with the pair of legs with heads thereon, the fascia retainer member, and the pair of legs with the latches thereon.

Another aspect of the present application provided a system for interconnecting modular wall vertical frame members meeting at a corner junction. The system comprises a first vertical frame member, a second vertical frame member, and a connector. Each vertical frame member has a mount for mounting a wall panel. Each vertical frame member has a pair of interlocking members positioned inwardly of the mount. The interlocking members each have a laterally extending leg defining a laterally extending latch receiving space. The connector member has a body structure with a pair of legs with latches thereon extending therefrom. The legs with the latches extend to form a general V-shape. The legs with the latches are configured to be received in the latch receiving spaces of the vertical frame members in a latching engagement to secure the vertical frame members in a corner junction relationship. The body structure of the connector member includes a head configured to be received between portions of the vertical frame members to support the corner junction relationship.

The laterally extending leg of each interlocking member may be spaced from an inner wall of the vertical frame member to define the laterally extending latch receiving spaces. The head of the connector member may connect the pair of legs such that the legs extend therefrom. The head may be configured to be received between free ends of the inner walls as the portions support the corner junction relationship.

The head may include a support bridge extending between the legs of the connector member.

The head may have a generally triangular configuration.

The connector member may consist of the body structure with the pair of legs with the latches and the head.

The at least one of the mounts for mounting the wall panel may be in the form of at least one channel configured to receive a glass panel wall section therein. The at least one channel may include smaller channels that are configured to receive a gasket to seal the glass panel wall section.

The at least one of the first vertical frame member and the second vertical frame member may include a central section with the mount in the form of a channel for mounting a single pane glass panel wall section as its wall panel. The mount may include a gasket channel for receiving a gasket to seal the glass panel wall section.

The at least one of the first vertical frame member and the second vertical frame member may include a central section with the mount in the form of two channels, each channel for mounting a respective glass panel wall section to provide a double pane glass wall panel as its wall panel. The mount may include two gasket channels each for receiving a gasket to seal the glass panel wall sections.

The at least one of the first vertical frame member and the second vertical frame member may be configured for a wall having its own internal frame with a vertical frame member and may include a main body with a member serving as the mount. The main body may include a longer supporting wall and a shorter supporting wall to support sections of the member.

For each vertical frame member, the laterally extending legs may be spaced from the inner walls of the respective vertical frame member and may be connected thereto at one end and may have an opposing end free for enabling insertion of the leg with the latch of the connector member into the latch receiving space of the respective vertical frame member.

For each vertical frame member, the inner walls may share a common wall extending laterally with respect to the frame member that is part of the mount.

The laterally extending legs may include undulating configuration features, detent features, snap-fit features, press fit features and/or interference fit features on the surface inside the latch receiving space of the vertical frame member. The features may be used for the latching engagement to secure the vertical frame members in the corner junction relationship.

The legs of the connector member each may include a free leg that has resiliency with an outer surface matching an inner surface of the laterally extending leg of the interlocking member to create the latching engagement. The latches of the connector member's legs each may include undulating configuration features, detent features, snap-fit features, press fit features and/or interference fit features.

The connector member may be a molded integral piece including the body structure with the head and the pair of legs with the latches.

Each vertical frame member may have a pair of lateral legs at the lateral edges thereof and a pair of inner legs extending inwardly. The inner legs may be spaced laterally away from the lateral edges. The head of the body structure of the connector member may be an outer head extending therefrom opposite the pair of legs with the latches. The outer head may be configured to be received between the inner legs and lateral legs of the vertical frame members as the portions support the corner junction relationship.

Each vertical frame member may have a pair of lateral legs at the lateral edges thereof and a pair of inner legs extending inwardly. The inner legs may be spaced laterally away from the lateral edges. The head of the body structure of the connector member that connects the pair of legs is a central web, and the connector member further comprises an outer head extending therefrom opposite the pair of legs with the latches.

The outer head may be configured to be received between the inner legs and lateral legs of the vertical frame members as further the portions to additionally support the corner junction relationship.

The at least one of the mounts for mounting the wall panel may be in the form of at least one channel configured to receive a glass panel wall section therein. The at least one channel may include smaller channels that are configured to receive a gasket to seal the glass panel wall section.

The at least one of the first vertical frame member and the second vertical frame member may include a central section with the mount in the form of a channel for mounting a single pane glass panel wall section as its wall panel. The mount may include a gasket channel for receiving a gasket to seal the glass panel wall section.

The at least one of the first vertical frame member and the second vertical frame member may include a central section with the mount in the form of two channels, each channel for mounting a respective glass panel wall section to provide a double pane glass wall panel as its wall panel. The mount includes two gasket channels each for receiving a gasket to seal the glass panel wall sections.

The at least one of the first vertical frame member and the second vertical frame member may be configured for a wall having its own internal frame with a vertical frame member and includes a main body with a member serving as the mount. The main body may include a longer supporting wall and a shorter supporting wall to support sections of the member.

For each vertical frame member, the laterally extending legs may be spaced from the inner walls of the respective vertical frame member and are connected thereto at one end and have an opposing end free for enabling insertion of the leg with the latch of the connector member into the latch receiving space of the respective vertical frame member.

For each vertical frame member, each laterally extending leg of the interlocking members may be positioned inwardly of the associated inner leg so that the insertion of the leg with the latch of the connector member into the latch receiving space of the vertical frame member takes place without interference from the inner leg.

For each vertical frame member, the inner walls may share a common wall extending laterally with respect to the frame member that is part of the mount.

The laterally extending legs may include undulating configuration features, detent features, snap-fit features, press fit features and/or interference fit features on the surface inside the latch receiving space of the vertical frame member.

The features may be used for the latching engagement to secure the vertical frame members in the corner junction relationship.

The legs of the connector member each may include a free leg that has resiliency with an outer surface matching an inner surface of the laterally extending leg of the interlocking member to create the latching engagement. The latches of the connector member's legs each may include undulating configuration features, detent features, snap-fit features, press fit features and/or interference fit features.

The connector member may be a molded integral piece including the body structure with the head and the outer head, and the pair of legs with the latches.

The outer head of the connector member may help support the corner junction relationship by maintaining proper distance between the lateral leg of each vertical frame member and the opposing inner leg of the other vertical frame member, which also helps prevent the lateral leg from being deformed inwardly in the event it receives force against it after modular wall is erected.

Other objects, features, and advantages of the present application will become apparent from the following detailed description, the accompanying drawings, and the appended claims.

DETAILED DESCRIPTION OF THE ILLUSTRATED EMBODIMENT(S)

Figure 1:
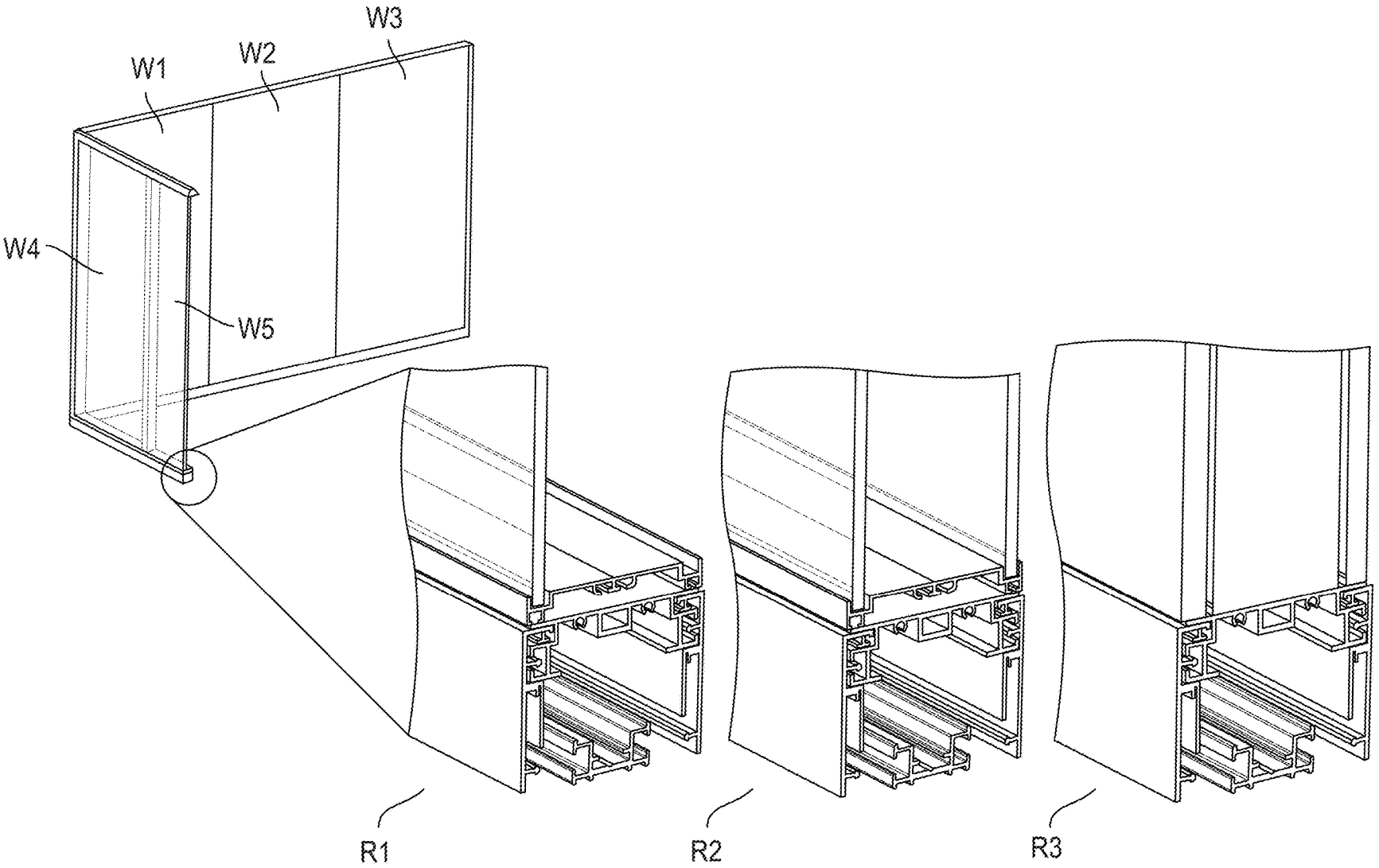
FIG. 1 shows an example of a partially constructed office space formed from modular walls where walls meet at corner and end-to-end junctions.

The present application discloses provides systems and connector members for interconnecting modular wall vertical members, such as those meeting at a corner or end-to-end junction. FIG. 1 shows an example of a partially constructed office space formed from modular walls where walls meet at corner and end-to-end junctions. The space constructed need not be office related, and can be any setting, including residential, factory, educational, or otherwise. The office example is not limiting and is used for illustrative context.

Modular walls typically have a frame supporting panels of a variety of styles. Such panels may be wood, frameless glass (or another translucent or transparent material), framed glass, gypsum, fiberboard, canvas exterior, metal, etc. Such panels can also be functional components, like a whiteboard, display screen, etc. The types of modular walls and panels thereof is not limiting and the examples mentioned herein are exemplary only.

In FIG. 1, for example, wall sections W1, W2 and W3 are shown meeting at end-to-end junctions, and wall sections W1 and W4 are shown meeting at a corner junction. A partial, cut-away wall section W5 also shown meeting wall section W4 at an end-to-end junction. Wall sections W1-W3 are shown as having wood, fiberboard or other non-transparent material, while wall sections W4 and W5 are glass wall sections. FIG. 1 also shows a detailed view of different options for a bottom rail of wall sections W4 and W5, including a version R1 for mounting a single pane of glass, a version R2 for mounting two panes of glass, and a version where the glass is replaced with two solid wood or fiberboard panels with acoustic dampening material therebetween (which may be used for wall sections W1-W3). These examples are not limiting, and are provided simply to provide context of the types of wall sections that can be connected together using the features described herein below.

Figure 2:
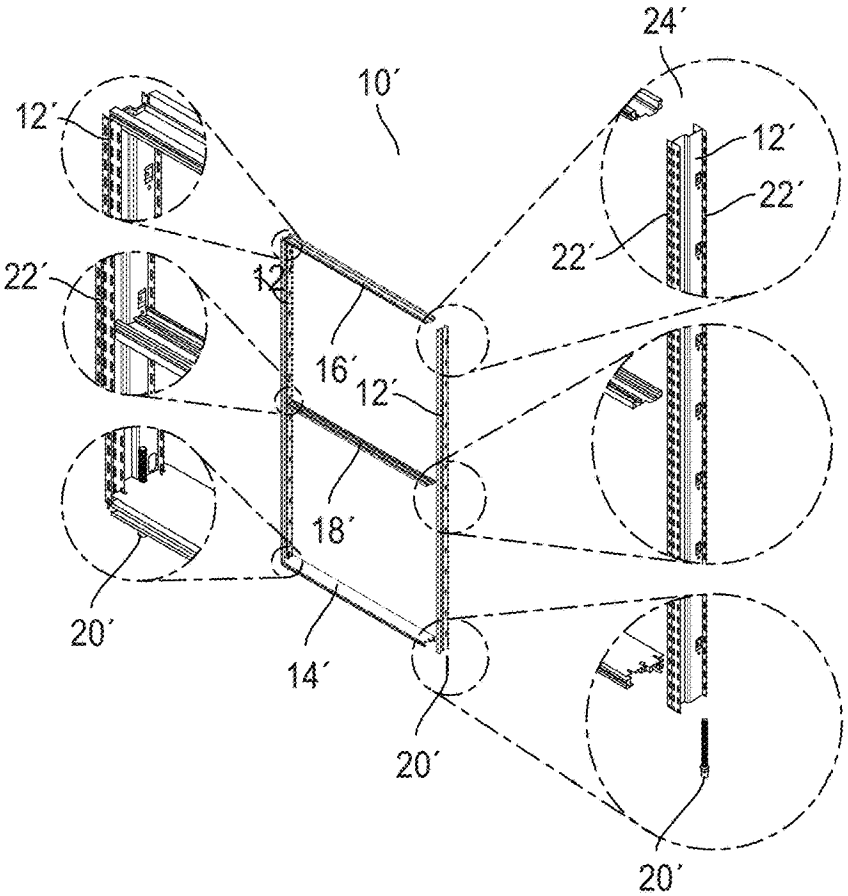
FIG. 2 shows examples of internal frames used for mounting wall panels.
Figure 2:
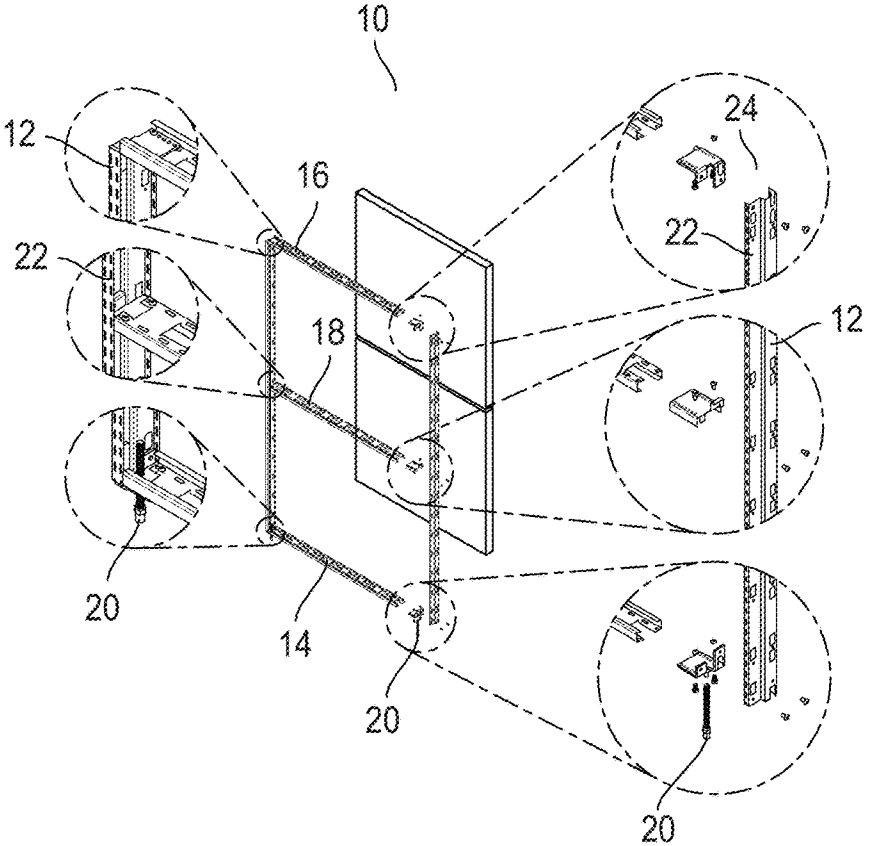

FIG. 2 shows examples of internal frames 10 and 10' used for mounting wall panels made of wood, fiberboard, gypsum, etc., or framed glass panels. The frame may come pre-assembled or be assembled at the installation site. Corresponding parts for the second example 10' are denoted with a 'on the reference number. The frame 10, 10' generally includes a pair of vertical rail members 12, 12', a bottom rail 14, 14', a top rail 16, 16' and at least one intermediate horizontal rail 18, 18'. These rails are assembled together using any types of fasteners. The bottom rail 14 or vertical rail member 12' has a height adjuster 20, 20', respectively, that can be used to vertically adjust a height of the internal frame member 10, 10' to better match the ceiling and align components as needed.

The vertical frame members 12, 12' each have a series of vertically arranged openings 22, 22' for mounting wall panels 24 during assembly. These openings 22, 22' may also be used for mounting other accessories. The frame members 12, 12' may also have a stepped configuration 24, 24' with two web sections connected by a transition section, with the vertical frame members 12, 12' of each frame 10, 10' being inverted with respect to one another. That is, the stepped configuration on one vertical frame member is flipped around (about its vertical axis) with respect to the other, so that when two internal frames of the same construction (or at least the same vertical frame member type) meet end-to-end their adjacent frame members can interface with each other easily without substantial spacing therebetween (see FIG. 3). This provides an easy ability for the wall sections of the same type (or with the same vertical frame members) to be connected in end-to-end relation.

The details in FIG. 2 are not intended to be limiting, and instead are provided solely as an example for providing context for the features discussed below, including other junction situations.

Figure 4:
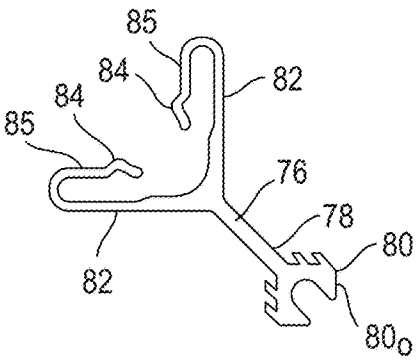
FIG. 4 is a cross-section or end view of a connector member shown in FIG. 3.
Figure 3:
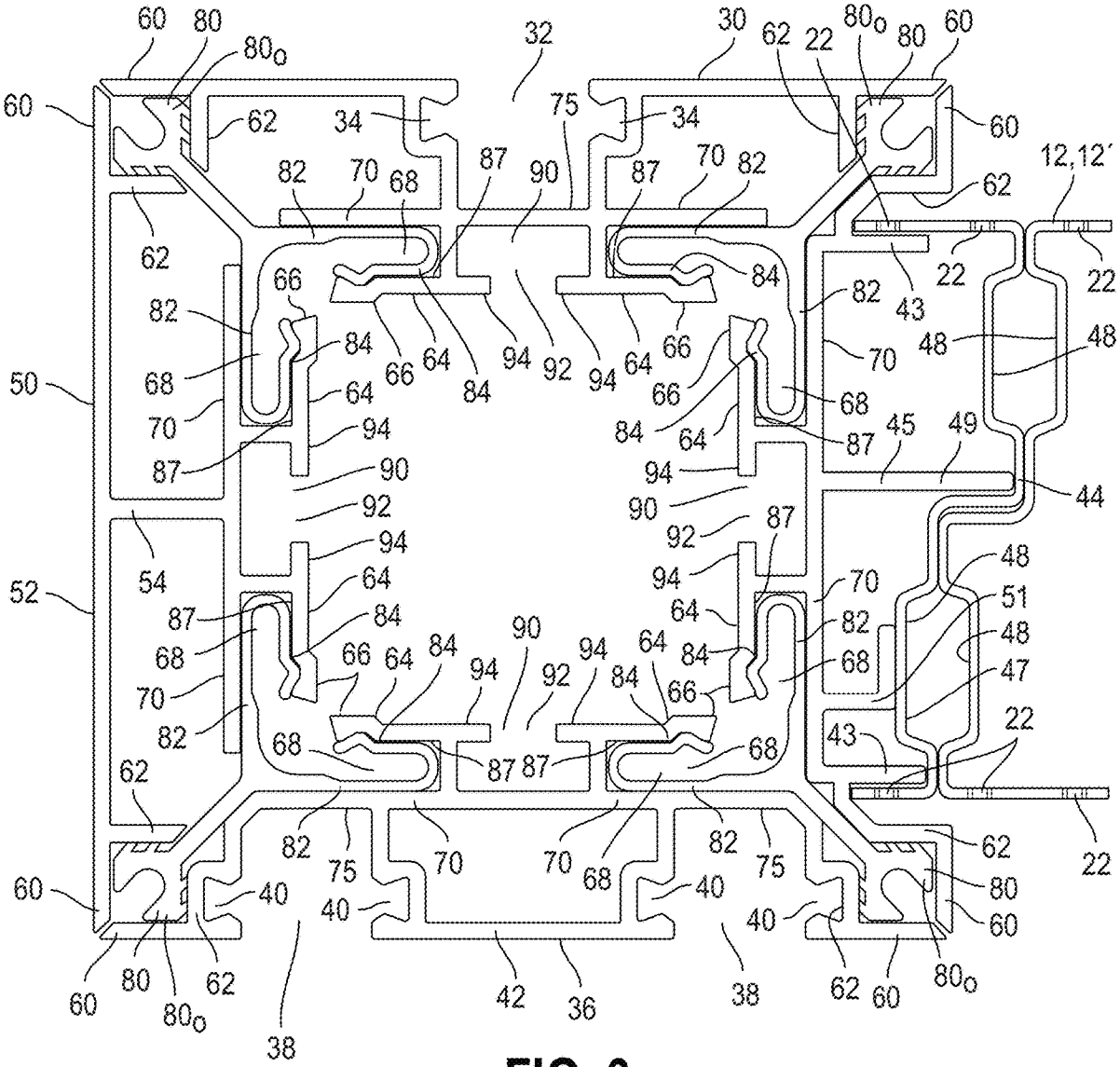
FIG. 3 illustrates four corner junctions between four different vertical frame members that may be included in the system.
Figure 5:
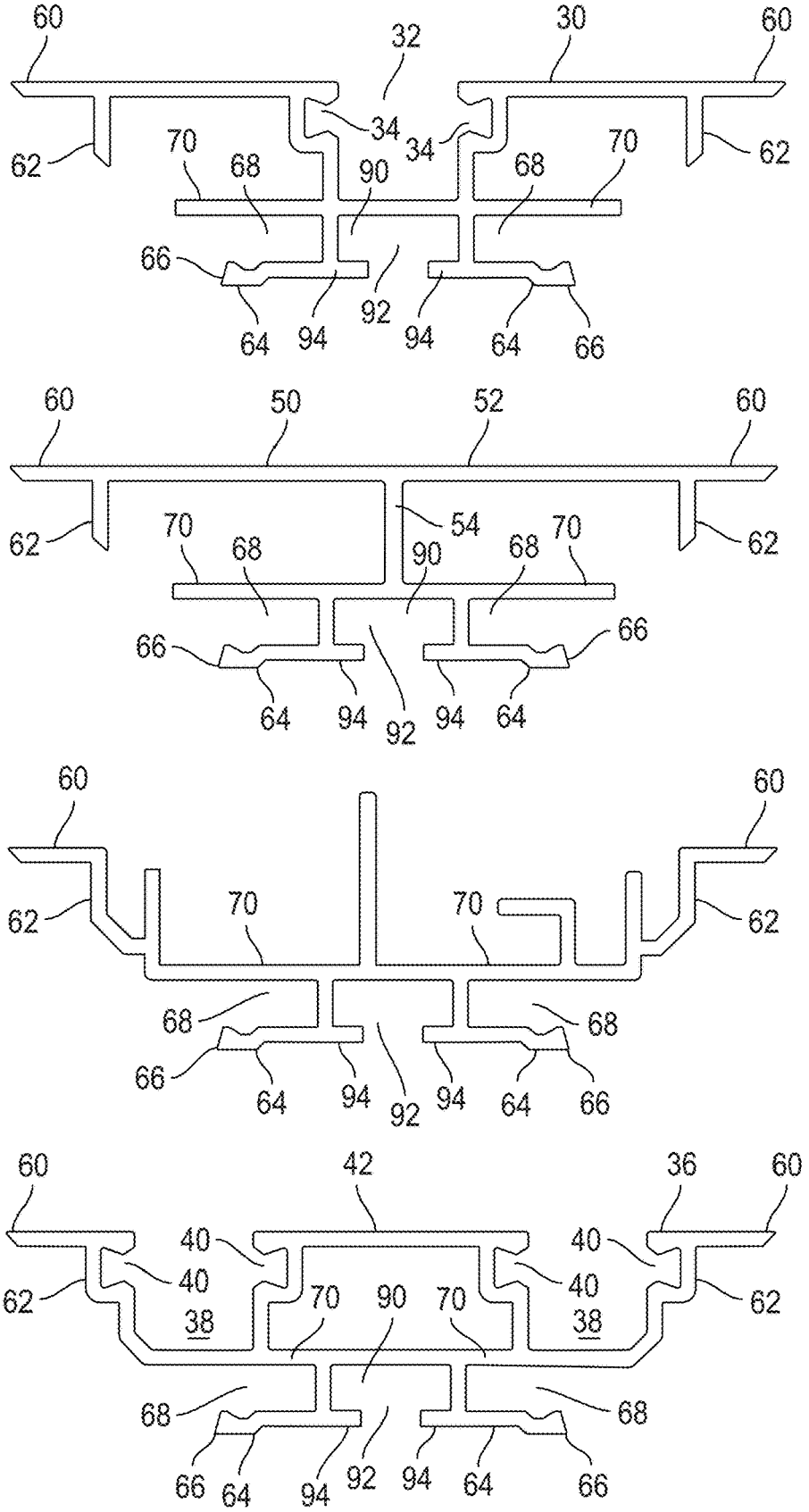
FIG. 5 shows cross-sections or end views of the vertical frame members shown in FIG. 3.

FIGS. 3-5 relate to a connector and system for establishing a corner junction where two wall sections meet at a corner. FIG. 3 illustrates four corner junctions between four different vertical members that may be included in the system. FIG. 3 is for illustrative purposes to show how a corner can be made, and it should be understood often only two wall sections are involved in a corner junction.

At the top of FIG. 3, a vertical frame member 30 for a single pane glass panel wall section is shown, which has a central section with a mount in the form of a channel 32 for receiving a single glass panel (not shown). The channel 32 may also have smaller optional channels 34 for receiving a gasket (not shown) to seal the glass panel. Other components common to the various vertical frame members will be discussed later.

At the bottom of FIG. 3, a vertical frame member 36 for a double pane glass panel wall section is shown, which has a central section with a mount in the form of two channels 38 each for a respective glass panel with two optional gasket channels 40 for receiving a gasket to seal the glass panels. An optional web 42 extends between the inner side walls of the two channels 38.

At the right of FIG. 3, a vertical frame member 44 for a wall having its own internal frame with a vertical frame member, like the wall in FIG. 2, and any other wall having frame components creating an internal frame. The example at the right of FIG. 3 shows the frame member 44 including a main body 45 with a member 47 serving as a mount, which is of the same type or cross-section as the frame member 12, 12' (a stepped configuration) used for the internal frame of a wall section. The frame member 44 can thus be connected to the end of a wall section using connections between the member 47 and the frame member 12, 12' in a manner similar to how the frame members of wall sections are connected at end to end junctions, with fasteners connecting member 47 (and thus in turn the frame member 44) to the frame member 12, 12' of the wall section. That establishes mounting of the panel to the frame member 44 indirectly through the panel's frame. For further details in this regard, reference may be made to U.S. Provisional Appln. Ser. No. 63/327,389, which is incorporated herein in its entirety for all purposes. The illustrated body 45 also has a longer supporting wall 49 and a shorter supporting wall 51 to support sections of the member 47. The member 45 also has a pair of flanges or legs 43 to which flanges on the member 47 is attached, such as by fasteners, including snap-fits, adhesive, nuts/bolts and the like. The attachment between the members 45 and 47 may be done prior to installation, such as at the manufacturing site, or may be done during installation. For example, the member 47 may be attached to the frame member 12, 12' of the wall section first, and then the member 45 is attached thereto.

In other embodiments, the frame member 44 can be made in one piece for attachment to any vertical frame member of a wall section. For example, a frame member 44 could have a stepped configuration designed into it as one continuous part, thus avoiding the addition of a separate part like 47 to serve as its mount for the panel and its internal frame. If fasteners are used on the vertical frame member 12, 12' for connecting horizontal frame members, fastener receiving portions or pockets may be added to accommodate those fasteners without interference, as shown in the aforementioned incorporated application (which would be similar to those marked 48 on 12/12' and 47). Other designs where a stepped configuration is not needed may also be used, and thus the mount part may have any configuration. Such an embodiment can be attached directly to the vertical frame member of a wall section for facilitating establishment of a corner junction. In other embodiments, the frame member 44 can be included in the internal frame of a wall section, with it mount for the panel(s) being where the panel mounts directly. Thus, the present application is not limited to the details illustrated.

In the illustrated design, the frame member 44 may be attached to a vertical frame member 12, 12' of a wall section when a corner junction is involved. This is preferred to enable the wall sections to be made with the same vertical frame members 12, 12' throughout, and adding the vertical frame member 44 at only those locations where a corner junction is formed (which will be much fewer). It is also possible in some embodiments to create the vertical frame member 44 so that the wall panels can be mounted directly thereto, such that it need not be attached to another vertical frame member 12, 12' (in other words, it can be modified to include the panel mounting parts of and be used in place of a vertical frame member 12, 12' instead of being attached to it, and hence its mount for a panel or the panels may have that structure).

Any type of mount for a single panel or multiple panels may be used, and the particular structure is not limited to any configuration. The mount is generally on the outer side with respect to a junction (which is also the inner side with respect to the wall section meeting at that junction). Generally, directions like inner and outer (or terms of similar import) as used herein will be with reference to the junction unless the context dictates otherwise. Similarly, the direction lateral refers to the lateral direction of a part relating to a junction, which is also in the same direction as a thickness or depth of an associated wall section, unless the context dictates otherwise.

At the left of FIG. 3 is a fascia trim member 50. A vertical frame member is a vertical member that serves a predominantly structural support or interconnection role, like supporting a panel, while a fascia trim member like member 50 (and any others) is a vertical member that serves a predominantly ornamental role and can be removed or replaced without disassembly of the wall section. The trim member 50 has a flat exterior wall 52 and optionally a supporting central web 54 for supporting the wall 52. This fascia trim member 50 is used for concealing the inner area of the corner junction, and specifically a pair is typically used. The details of how the trim member 50 is used will be discussed in further detail below. It should be understood that a frame member may have some aesthetic aspects and surfaces that can be seen that are finished as trim. However, that would not change the frame member's role of providing structural support or a connection. For example, on members 30 and 36 because the surfaces on opposing outer sides of the channels 32, 38 may be visible, those surfaces may be finished as trim surfaces, although the members 30 and 36 would still be regarded predominantly serving the structural purpose of retaining the glass pane(s). Similarly, on frame member 44, the surfaces extending away from the part of an internal frame (i.e., the surfaces on member 44 extending out to flanges 60) may likewise be visible and finished as trim. Frame member 44, however, still serves a predominantly structural role because it establishes the connection between the internal frame of that wall section and the corner junction. It is also possible in certain installation configurations that no part of frame member 44 is visible if a panel mounted to the internal frame covers those flanges 60, thus making member 44 entirely structural in purpose. Likewise, a trim member like trim member 50 (or any other trim member) can have parts performing a secondary structural role, like features for helping route wires or an opening for a plug socket, while still predominantly performing an aesthetic function as trim. Thus, some members considered as structural frame members may have some trim or aesthetic aspects, while some ornamental trim members may have some structural aspects, each without changing how a person of ordinary skill in the art would understand its role.

Each of these members 30, 36, 44, 50 have common components on the inner face thereof (the side facing into to the corner junction). Specifically, each vertical member 30, 36, 44, 50 also has a pair of lateral legs 60 at the lateral edges thereof and a pair of inner legs 62 extending inwardly. The lateral legs 60 are shown as continuous with the face of the central section that receives a wall panel (or in the case of trim member 50 is exterior or outer trim surface), but may be offset or differently configured. The inner legs 62 are spaced laterally away from the lateral edges.

Each vertical member 30, 36, 44, 50 also has a pair of interlocking members 64 positioned inwardly of its central section. The interlocking members 64 each having a laterally extending leg 66 defining a laterally extending latch receiving space 68. These legs 66 are spaced from inner walls 70 of the members (inner referring to towards the corner junction) and are connected thereto at one end and have an opposing end free for enabling insertion into the space 68. These structures are also positioned inwardly of the inner legs 62 so that the insertion discussed below can take place without interference from the legs 62. As can be seen in the drawings, the legs 66 may have an undulating configuration, and detents, snap-fit features, other shaped features, or press or interference fit may also be used for the latching engagement on the surface inside the space 68. Latching as used herein broadly refers to any features that engage for secure connection between the components. Adhesives, pins, or other fasteners may also be used. These features may have any construction or configuration, and are not intended to be limiting.

These four vertical members 30, 36, 44, 50 are also shown in FIG. 5, showing them isolated from the connector member discussed below.

It should be understood that the vertical frame members 30, 36, 44 can be of any type for interfacing with a panel or panels of a wall section, and the illustrated configurations for such interfacing are not limiting (the function of the trim member 50 is discussed below). The frame members may be included as part of a pre-assembled internal frame for the wall sections (i.e., the frame is pre-assembled in advance so it can be stood up in place at the installation site, including being pre-assembled at a factory location for shipment to the installation site). In some embodiments, the entire wall section may be pre-assembled with the panels installed on the internal frame. In other embodiments, the various components of a wall section may come partially or completely disassembled, and be assembled as part of the installation process. Thus, the present application is not limited to any particular type of wall sections used to create the modular wall. In other embodiments, the vertical frame member may be separate from a wall section's frame and be designed to receive and support lateral edges of the wall section frame. In some designs, the wall panel may be frameless, such as frameless glass panels, and the vertical frame members are configured to receive and support lateral edges of the panel.

In the illustrated embodiment, these members 30, 36, 44, 50 are roll-formed from metal, such as steel or aluminum. This is a preferred approach, but other forms of manufacturing may be used, such as extrusion, stamping (including progressive or sequential stamping) may be used. Similar other materials, like rigid plastics or composites may be used. For the trim members, if metal is used further polishing, finishing, or other enhancements may be done for aesthetics. Also, plastics, or combinations of material (like a plastic inner structure with finished outer surfaces of wood, metal, etc.) can be used for better appearance.

Any two of these frame members 30, 36, 44 from adjacent wall sections meeting at a corner junction may be regarded as part of a system comprising a first vertical frame member and a second vertical frame member, each of which is respectively part of adjacent wall sections. That is, one frame member is from one wall section and the other frame member is associated with another, adjacent wall section. The wall sections may of the same type of a different type, and the common inner components provides for modular connection as discussed below.

The system also includes a connector member 76, which is included at each corner junction in FIG. 3 and shown individually in FIG. 4 separate from the other components. The connector member 76 has a body structure 78 with a head 80 extending therefrom and a pair of legs 82 with latches 84 thereon extending therefrom opposite the head 80. The body structure 78 may have any configuration, and in the illustrated embodiment it is a planar central web. The legs 82 with the latches 84 extend to form a general V-shape. Typically, the angle is at 90 degrees, which is used for creating perpendicular corner junctions. If a non-perpendicular corner is desired, a different angle may be used.

The legs 82 with the latches 84 are configured to be received in the latch receiving spaces 68 of the vertical frame members in a latching engagement to secure the vertical frame members in a corner junction relationship, as shown in FIG. 3. The head 80 is configured to be received between the inner legs 62 and lateral legs 60 of the vertical frame members to support the corner junction relationship. As shown, when the frame members meet at a corner junction, the legs 60, 62 of each meet to create a space bounded by the legs in which a head 80 is received. The head 80 helps support the corner junction relationship by maintaining proper distance between the lateral leg 60 of each frame member and the opposing inner leg 62 of the other frame member. This also helps prevent a lateral leg 62 from being deformed inwardly in the event it is bumped or otherwise struck or receives force against it after the wall is erected.

The latches 84 also have a configuration designed to latch within the spaces 68. In the illustrated embodiment, the latches 84 have a free leg that has resiliency with an outer surface matching the inner surfaces of the leg 66 of the interlocking members 64 to create the latched engagement. The latch 84 may have other configurations, including detents, snap-fit features, or any of the other options discussed above may be used.

The connector member 76 may be extruded as a single piece, preferably from plastic, although it can be extruded from metal as well. The connector member 76 can also be formed by other approaches, including injection molding, overmolding to a central component, or the like.

In some embodiments, the head 80 and legs 82 can extend the entire vertical length of the connector member 76 (particularly when extruded, as extruded parts generally have the same cross-section along their length). In other embodiments, the connector member 76 can have a plurality of sets of heads 80 and legs 82 spaced apart from one another in the vertical direction. This would provide connections at distinct locations, rather than along the entire length.

With the illustrated design, creating a corner junction is straightforward. The first wall section has the connector member 76 connected thereto with one of the latches 84 on a leg 82 inserted into the latch receiving space 68 and secured thereto, while the head 80 is positioned between the lateral and inner legs 60, 62 thereof. This may be done before or after the first wall section is erected. Once that is done and the first wall section is erected, the second wall section can be erected and connected by engaging its latch receiving space 68 over the other latch 84 on the other leg 82 so it is secured thereto, and its lateral and inner legs 60, 62 are positioned on the opposing sides of the head 80. This establishes the corner junction with relative ease. Additional fastening may be used if desired.

The head 80 has resilient fingers or barbs thereon, which are optional. These fingers may be compressed during assembly, which may help take up any tolerance differences between parts engaged therewith, ensure essentially equal pressure throughout the junction by providing dynamic tension, and/or assist in improving alignment. The fingers may also help provide additional sealing and block light/sound transmission through the junction. These are optional advantages and not limiting. The fingers may be integrally molded with the head 80 from the same material, or may be co-molded or co-extruded from a lower durometer material than the 80 to provide a part of varying durometer. These manufacturing options are also not limiting.

The same can be done to create a corner junction where three walls meet with two wall sections aligned end-to-end and another extending at an angle, which is typically perpendicular (which may be referred to as a T-junction or double-corner junction). Using FIG. 3 as a non-limiting example, the frame member 30 can be considered as associated with a wall section of the exterior wall of office A that has a single glass pane, the frame member 36 can be considered as associated with a wall section of the exterior wall of adjacent office B that has a double glass pane, and the frame member 44 can be considered as associated with a wall section of an interior wall that separates office A and B that has wood, fiberboard or other type of panels. The particular panels are examples, and not limiting, and any combination of walls and panels can be used. In this situation, the same process discussed above can be used to add an additional wall section to the junction. For example, using the example of FIG. 3, frame members 32 and 44 can be connected in the manner discussed above using a connector member 76 to create a corner junction therebetween at one lateral side of frame member 44, and then frame member 36 can be connected to the other lateral side of frame member 44 using another connector member 76 to create another corner junction therebetween in the manner discussed above. The order of connections is not limiting, and in this example frame members 36 and 44 could be connected together first before connecting frame member 32. Likewise, the wall sections associated with frame members 32 and 36 could be erected first so they are aligned in an end-to-end relation and then both connector members 76 could be used to connect the frame member 44 to both the frame members 32 and 36 during erection of the wall section associated with the frame member 44.

Figure 8:
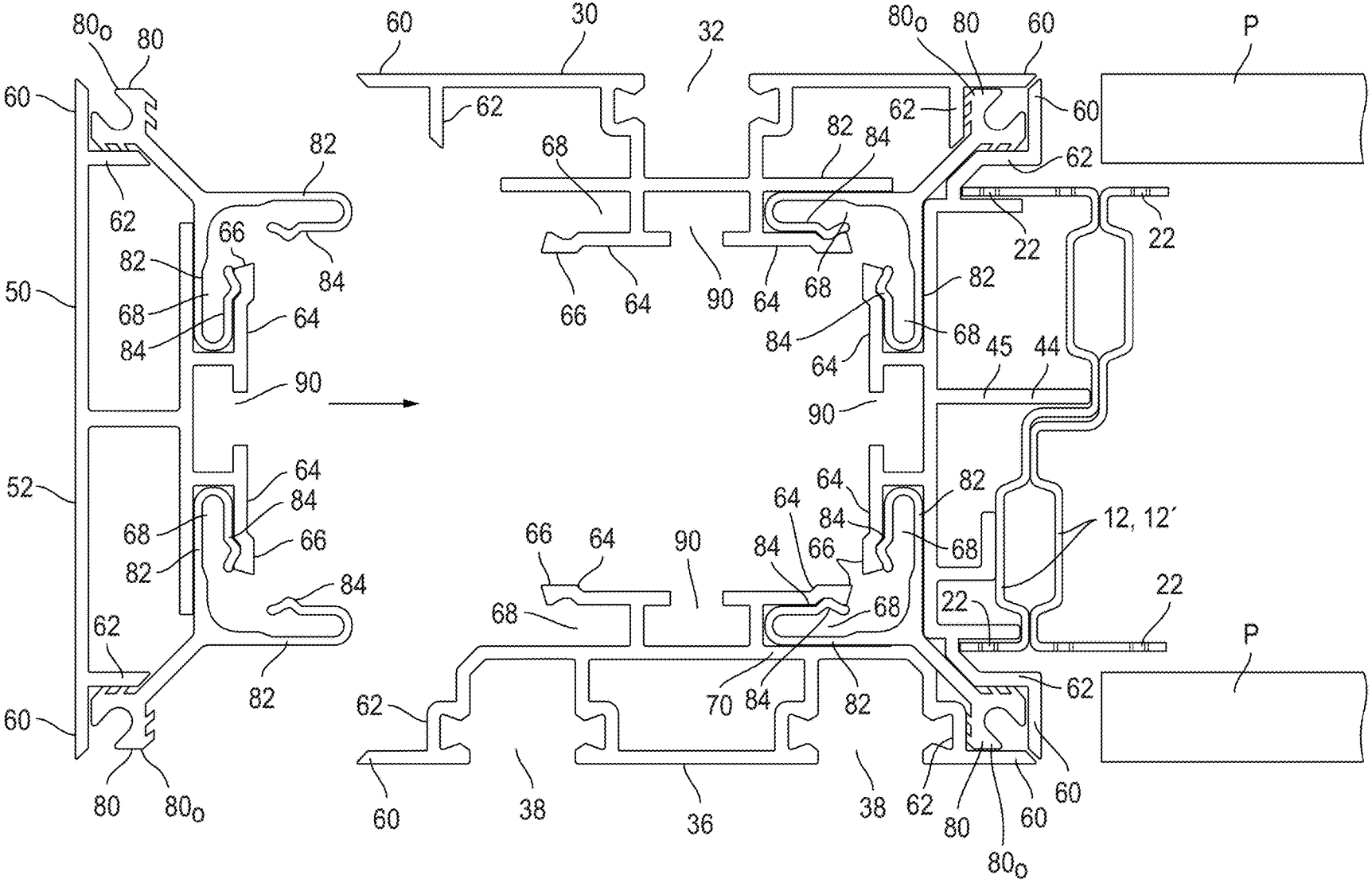
FIG. 8 shows part of the assembly process for a double corner T-junction where the members have been installed and the trim member 50 being installed.

FIG. 8 shows part of the assembly process for a double corner T-junction where the members 30, 36, and 34 are installed as discussed above with panels P on the wall section associated with member 44, and the trim member 50 being installed. The trim member 50 has the connector members 76 attached thereto, which have their latches 84 being inserted into the spaces 68 of the members 30, 36 as the trim member 50 is installed (shown as moving to the right in the drawing).

Each of the vertical members 30, 36, 44 and 50 may have a retainer structure 90 comprising a channel 92 with a pair of inwardly extending flanges 94. Additional components to be located inside the corner junction may have a pair of matching interfacing structures, such as T-shaped inserts, snap-fit features or any other insertable structure (which are at 90 degrees to one another on the rear/inner side of the trim for a perpendicular corner, or at another angle if the corner has a different angle) can be inserted into the channels 92 or connected to another retainer structure to retain the component in place. For example, a conduit for routing electrical wire, network cables, pipes or another water/fluid conduit, air conduits or the like could be connected inside the corner junction using such features. Also, additional connection structure could be added to those retainer structures with the same types of matching interfacing structures for securing the vertical members meeting at the corner junction together could also connect to such features within the confines of the corner junction.

As illustrated, in each vertical member 30, 36, 44, 50, the channel 90 and the inner walls 70 for the interlocking members 64 share a common wall extending laterally with respect to the frame member. That common wall is also essentially parallel to the walls of the central outer section, such as where channels 32, 38 are located (or the exterior surface of the illustrated trim member 50). That design is not limiting and any shape or configuration may be needed.

A non-limiting advantage of the illustrated design is that these connections between the interlocking members 64 and the latches 84, and the configuration of the head 80 and the lateral and inner legs 60, 62, is that after initial installation a height adjuster (or adjusters) on one or all wall sections meeting at the junction can still be used to make vertical height adjustments for any of the wall sections as needed. Specifically, those components on the vertical members have the same cross-section perpendicular to the vertical direction, thus allowing for vertical movement of one vertical frame member relative to the other without interference from the heads 80 and latches 84. This would typically be done before the installation of the trim member(s) 50 discussed below, but because each trim member 50 also has the same connective structure on the inner side it is also possible to make such adjustments after the trim is installed if needed.

When the corner junction is completed between two or three wall sections, trim may be used to cover the corner junction at the exterior angle side (referring to that side in the geometry sense). That may be unnecessary where that exterior angle side is against another structure and not exposed to view. For example, a modular wall structure can be built up against the pre-existing wall of a building such that the exterior angle side is facing that pre-existing wall, and hence no trim covering is needed. However, when the corner junction has its exterior angle side exposed, trim members such as the vertical trim member 50 may be used.

Continuing with the example in FIG. 3, an example of a junction between wall panels where a corner junction has been established by frame members 30 and 44 will be considered as a non-limiting example for context. With that corner junction is formed, two trim members 50 and three additional connector members 76 may be used. One trim member 50 will be connected to the frame member 30 using a connector member 76 in the same manner as described above, with that connector member 76 having (a) its latches 84 each connected the interlocking members 64 of both that first trim member 50 and the frame member 30, respectively and (b) its head 80 between the lateral and inner legs 60, 62 of both that first trim member 50 and the frame member 32 (which is shown in FIG. 3). The second trim member 50 will be connected to the other frame member 44 using another connector member 76 in the same manner as described above, with that connector member 76 having (a) its latches 84 each connected to the interlocking members 64 of both that second trim member 50 and the frame member 44, respectively, and (b) its head 80 between the lateral and inner legs 60, 62 of both that second trim member 50 and the frame member 44 (which essentially replaces the member 36 in FIG. 3 with another trim member 50). Both trim members 50 are also connected together by a third connector member 76 in the same manner with the latches 84, head 80, interlocking members 64 and legs 60, 62 not connected to the frame members 32, 44 playing the same role to connect the two trim members 50 together (again, the second trim member 50 is replacing member 36, and the connection at the lower left of FIG. 3 is the same).

A single trim member 50 can also be used at a T or double corner junction, such as the non-limiting example shown in FIG. 3. In that arrangement, the trim member 50 is added to the junction in the same manner, except only one is needed to conceal the inner space of the corner junction.

These trim members 50 can be easily removed and replaced to change styling/decoration of the modular wall. Likewise, if cable routing or other components are included inside the space of the junction, a trim member 50 can be removed for access and replaced. Also, if surfaces of a frame member, like member 30, 36 or 44, have visible surfaces, a frame member can also be removed and replaced to change the styling/decoration further. This would require additional steps, but because the panel itself can be re-used it is less expensive than replacing the entire wall section.

In another possible embodiment applicable to corner junctions for just two walls, a single fascia trim member having two exterior walls at an angle (typically 90 degrees for a perpendicular corner), or a rounded or faceted exterior wall can be used. Such a design would include the same general inner components, with legs 60, 62 and an interlocking member 64 at each lateral end thereof, and such a trim member would be connected at one lateral side to one vertical frame member using a connector member 76 and at the other lateral side to the other vertical frame member using another connector member 76 in the same manner as discussed above. For example, continuing with FIG. 3 as non-limiting context, if the frame members 30 and 44 are connected by a connector 76 in forming a corner junction, such a single trim member would be placed in the same general location as members 36 and 50, with the connector members 76 at each lateral end of the single trim member establishing connections to the interlocking members 64 of the single trim member and the frame members 30, 44 and having their heads 80 between the other sets of legs 60, 62 in the same manner as discussed above (here, other means the components on the lateral sides of the frame members 30, 44 that are not connected together by a connector member like that shown at the top right of FIG. 3). This design also eliminates the need for a fourth connector member (e.g., the lower left one in the example of FIG. 3, because the single trim member uses the connections at the top left and bottom right, and has its wall or walls extending therebetween).

Figure 6:
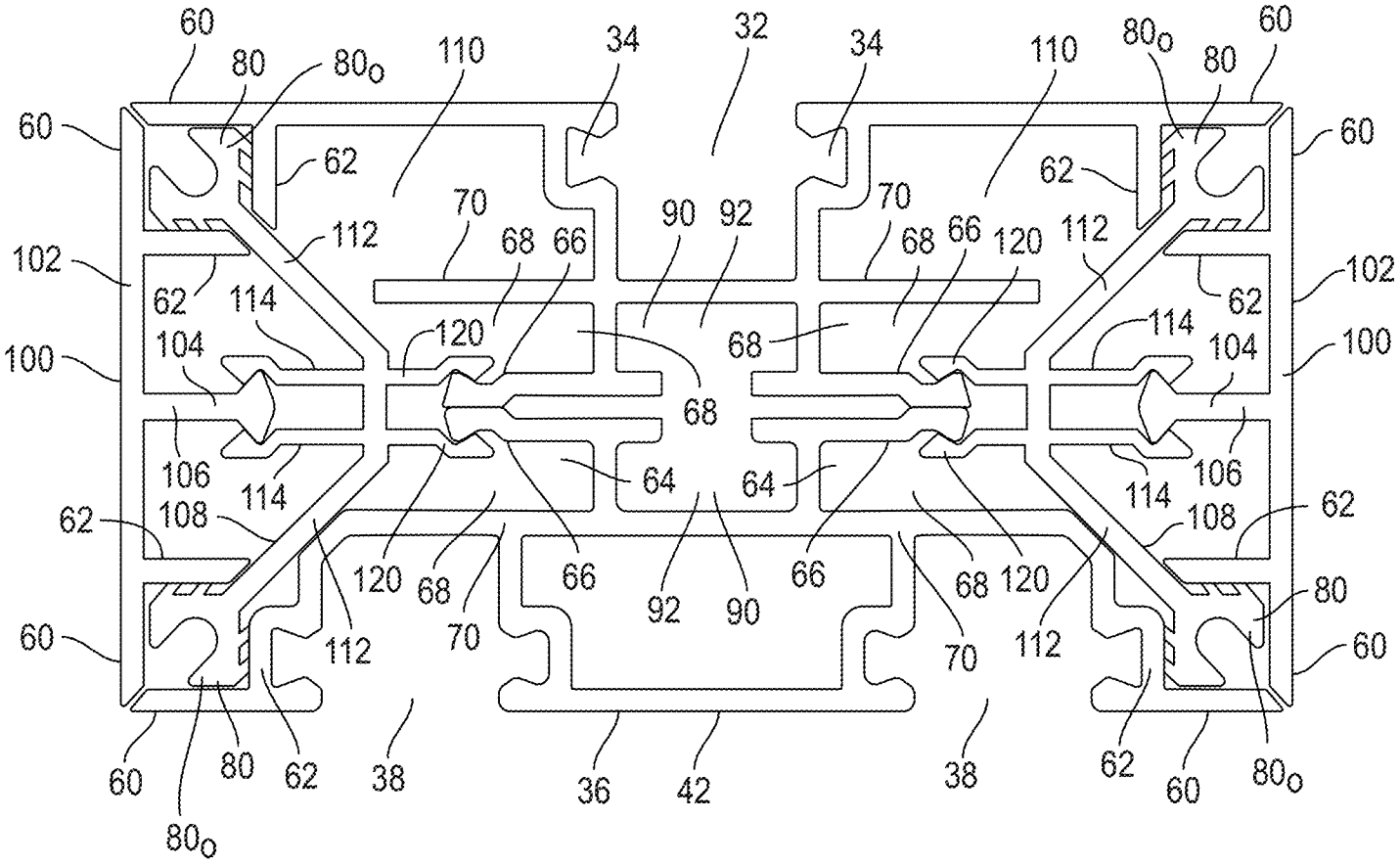
FIG. 6 illustrates an end-to-end junction between exemplary vertical frame members that may be included in the system.
Figure 7:
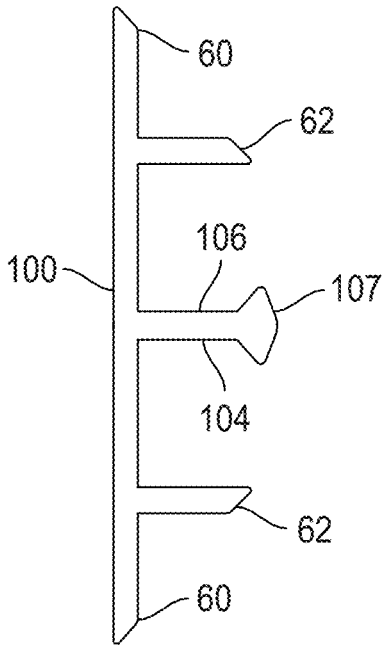
FIG. 7 is a cross-section or end view of a connector member shown in FIG. 6.

Another aspect of the present application provides a system for interconnecting modular wall vertical members meeting at an end-to-end junction. FIGS. 6 and 7 relate to this aspect of the present application. The vertical members at an end-to-end junction will typically be two vertical frame members, as shown in FIGS. 6 and 7. However, as will discussed below an end-to-end junction can also be formed between a vertical frame member of a wall section at the terminal end of a run (also called a peninsula wall, as discussed below) and a vertical trim member to provide finish for the terminal end. FIGS. 6 and 7 show the same vertical frame members 30, 36 discussed above as examples for context, and any combination of the frame members discussed above (or other frame members of different type) may be used. The examples in FIGS. 6 and 7 should not be considered limiting. For convenience, the same reference numbers for components of the exemplary frame members 30, 36 are used.

Any two frame members from adjacent wall sections meeting at an end-to-end junction may be regarded as part of a system comprising a first vertical frame member and a second vertical frame member, each of which is respectively part of the adjacent wall sections. The system comprises a first vertical frame member and a second vertical frame member, each vertical frame member having a central section with a mount for mounting a wall panel, as discussed above.

A vertical fascia trim member 100 is provided for covering a space formed between the vertical frame members 30, 36. One fascia trim member 100 may be used where only one side of the space between the frame members 30, 36 is exposed, and two vertical fascia trim members 100 may be used on opposing sides when both sides are exposed.

Each fascia trim member 100 has a pair of lateral legs 60 at the lateral edges thereof of and a pair of inner legs 62 extending inwardly and spaced laterally away from the lateral edges. The same reference numbers 60 and 62 from the corner junction context discussed above are used, as these structures serve the same purpose and hence the above discussion of those applies here equally.

The fascia trim member 100 illustrated also has a flat exterior wall 102 extending between the lateral edges. This wall 102 could have different configurations for ornamental purposes, such as a faceted or rounded shape, and may also include functional components also, such as an electrical connector or outlet or the like.

The fascia trim member 100 also has a retainer member 104 between the inner legs 62 thereof. The retainer member 104 may have any construction or configuration. In the illustrated embodiment, the retainer member 104 has an inwardly projecting member 106 extending inwardly from the wall 102 in the general center thereof and a head 107 on the free end thereof. As will be discussed below, the head 107 is enlarged to provide for a latching engagement with a connector member 108. Other constructions or configurations may be used. For example, the parts that latch could be reversed between the trim member 100 and the connector member 108, the engagement could use other forms of latching, such as other detents, snap-fits, press/interference fit or other types of interlocking connections.

The fascia trim member 100 may be made in the same manner as the other members discussed above.

Each connector member 108 has a body structure 110 with a pair of legs 112 with heads 80 thereon extending therefrom and the legs 112 with the heads 80 extend to form a general V-shape. The reference number 80 is used to reflect that the heads 80 on these legs 112 perform the same function as the head 80 on the corner junction discussed above, namely they are each configured to be received between the inner legs 62 and lateral legs 60 of the vertical frame members 30, 36 and the associated fascia trim member 100 to support the fascia trim member 100. The discussion above regarding the head 80 thus applies here equally, except that this connector member 100 has two instead of one. The connector member 108 may be formed in the manner described above for the connector member 76.

Each connector member 108 also includes a fascia retainer member 114 extending therefrom between the pair of legs 112. The fascia retainer member 114 is configured to engage the retainer member 106 of the fascia trim member 100 in a latching engagement to secure the fascia trim member 100 over the space formed between the vertical frame members 30, 36. In the illustrated design, the head 107 of the retainer member 106 on the trim member 100 is enlarged so that when it is received between the legs used as the fascia retainer member 114 it is received in a latching engagement, and the ends of the legs 114 have detents to grasp the head 107 securely. This construction allows the trim member 100 to be removed and replaced after the modular wall is installed, which enables design upgrades for a change of appearance as desired. As mentioned above, the engagement between the retainer members 106 and 114 may be of any type, including being reversed or using other structures, and are not limited to the illustrated design.

The connector member 108 also has a pair of legs 120 with latches thereon extending therefrom opposite the fascia retainer member 114. The legs 120 with the latches are configured to be received in the latch receiving spaces 68 of the vertical frame members 30, 36 in a latching engagement. In the illustrated design, the latches on the legs 120 engage the corresponding latching features on the inside of the legs 66 defining the latch receiving spaces 68. This latching may also be enhanced in the illustrated design where the legs 66 of the two adjacent frame members 30, 36 are abutting so that both can be received in the space between the legs 120. The resiliency of the material forming the legs 120 may be used to further enhance the latching. Again, as mentioned above, any types of retention may be used, and the disclosed approach is not considered limiting.

In some embodiments, the legs 120 may be sufficiently robust to be primarily responsible for securing the vertical frame members 30, 36 together in the end-to-end junction relationship. In other embodiments, the legs 120 may play a smaller role, such as providing additional securement in addition to other securement. For example, the two frame members 30, 36 may be secured together by a connecting structure secured to each of the retainer structures 90, or they may be secured by other types of fasteners, such clips, screws, nuts/bolts, or the like. In some embodiments, the legs 120 may perform essentially no role in securing the vertical frame members 30, 36 together, and may just serve the function of connecting the connector member 108, and in turn the trim member 100, to the frame members 30, 36.

As can be seen in FIG. 6, the end-to-end junction is formed by positioning the vertical frame members 30, 36 (or any two frame members) adjacent one another in end-to-end relation. This may be done before or after wall panels are installed thereto. The frame members 30, 36 are secured in the end-to-end relationship in any manner as discussed above. With the frame members erected, a trim member 100 can be attached to in the manner illustrated in FIG. 6. For example, the connector member 108 can be connected to the trim member 100 by engaging the retainer members 106 and 114 together, and then the trim member 100 can be installed by engaging the latches on the legs 120 in the receiving spaces 68 on one side of the adjacent vertical frame members 30, 36. The heads 80 will be received between the corresponding legs 60, 62 in the same manner as discussed above as the trim member 100 is installed. Alternatively, the connector member 108 can be installed first by engaging the latches on the legs 120 in the receiving spaces 68, and then trim member 100 can be installed by moving the trim member 100 into its installed position with the retainer members 106 and 114 engaging one another. If two trim members 100 are desired on both sides, then both can be installed using either approach, resulting in the configuration shown in FIG. 6.

The same non-limiting advantage discussed above of allowing one wall section to be adjusted vertically with respect to another at the junction applies equally to the end-to-end junction as well, which can take place after trim the trim is installed if needed.

As another alternative, the trim members 50 and 100 can be used together at a free terminal end of a wall section, which may be referred to peninsula wall section because the wall section extends out to a free end. In such an arrangement, the trim member 50 would be arranged as a vertical member in an end-to-end junction with the vertical frame member at the free end of the wall section, and a pair of the trim members 100 would be used in the same manner as shown in FIG. 6 connected therebetween in the same manner. The end-to-end junction is of the same type, except is between the vertical frame member of a wall section and the vertical trim member 50 (rather than another wall section). In the context of FIG. 6 as an example, if the vertical frame member 30 were at the free end of a wall section, the adjacent frame member 36 in the drawing would be replaced by the trim member 50 described previously with respect to the corner junction and the trim members 100 would have the same position. The connecting approach using the connector members 108 is generally the same and need not be repeated. This would conceal the free end of the wall section within the three trim members using the same modular components.

In one embodiment, a system for interconnecting modular wall vertical frame members 30, 36, 44, 50 (as shown in FIG. 1-8) or 30', 36', 144, 50' (as shown in FIGS. 9-16) meeting at a corner junction. The system comprising a first vertical frame member, a second vertical frame member, and a connector member 76 or 76'. Each vertical frame member has a mount 32, 38 or 32', 38' for mounting a wall panel. Each vertical frame member has a pair of interlocking members 64 or 64' positioned inwardly of the mount 32, 38 or 32', 38'. The interlocking members 64 or 64' each having a laterally extending leg 66 or 66' defining a laterally extending latch receiving space 68 or 68'.

The connector member 76 or 76' has a body structure 78 or 78' with a pair of legs 82 or 82' with latches 84 or 84' thereon extending therefrom. The legs 82 or 82' with the latches 84 or 84' extending to form a general V-shape. Typically, the angle is at 90 degrees, which is used for creating perpendicular corner junctions. If a non-perpendicular corner is desired, a different angle may be used.

The legs 82 or 82' with the latches 84 or 84' are configured to be received in the latch receiving spaces 68 or 68' of the vertical frame members in a latching engagement to secure the vertical frame members in a corner junction relationship. The body structure 78 or 78' of the connector member 76 or 76' includes a head 80 or 80' configured to be received between portions 62 and 60 or 70' of the vertical frame members to support the corner junction relationship.

The vertical frame members 30, 36, 44, 50, the interlocking members 64, the laterally extending leg 66, the latch receiving space 68, the mount 32, 38, the connector member 76, the body structure 78, the legs 82, and the latches 84 are all shown in and described in detail above with respect to FIGS. 3-8.

The vertical frame members 30', 36', 144, 50', the interlocking members 64', the laterally extending leg 66', the latch receiving space 68', the mount 32', 38', the connector member 76', the body structure 78', the legs 82', and the latches 84' are all shown in and described below with respect to FIGS. 9-16.

Figure 9:
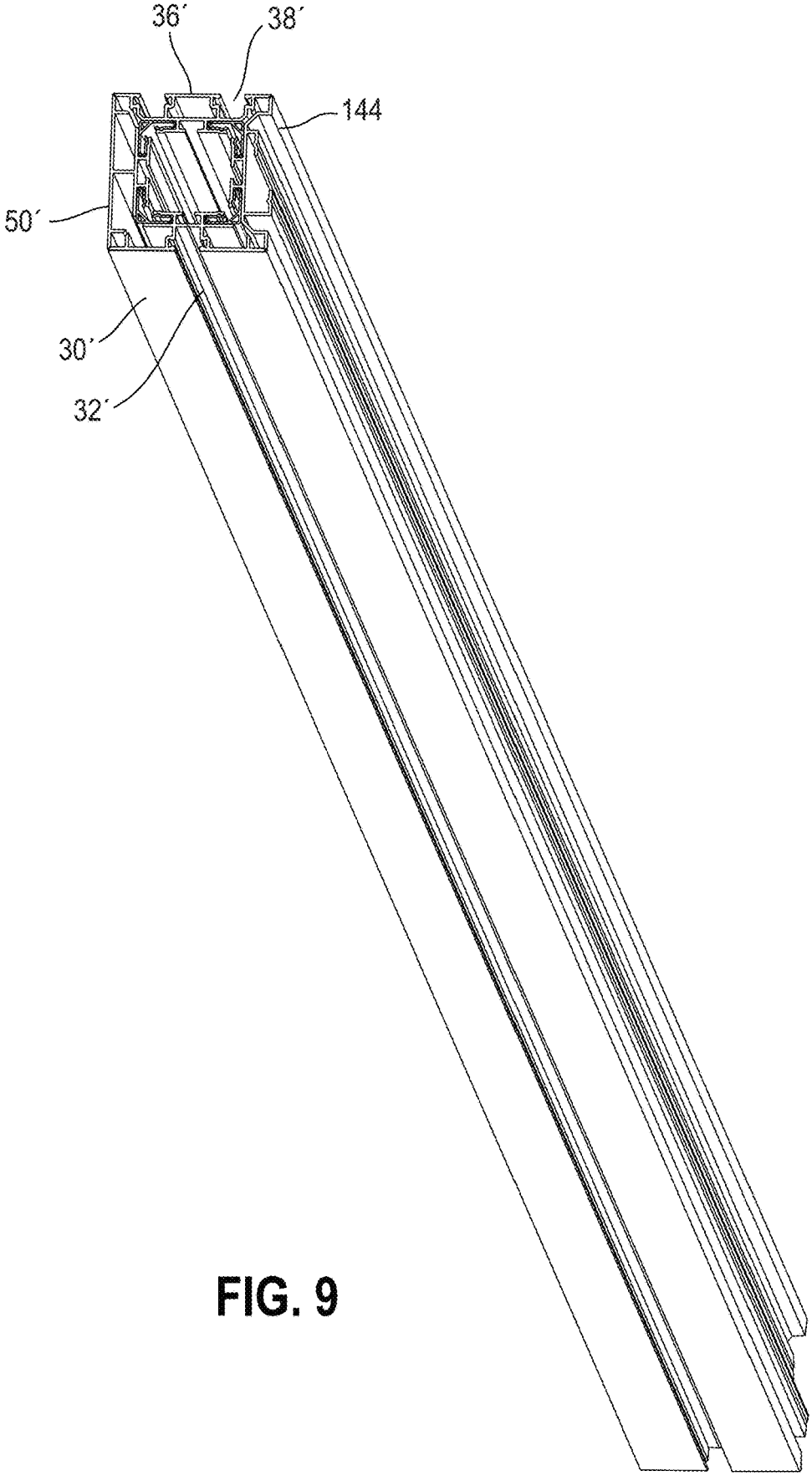
FIGS. 9 and 10 illustrate a perspective view and an end/a cross-section view, respectively, of four corner junctions between four different vertical frame members that may be included in the system in accordance with another embodiment of the present application.
Figure 10:
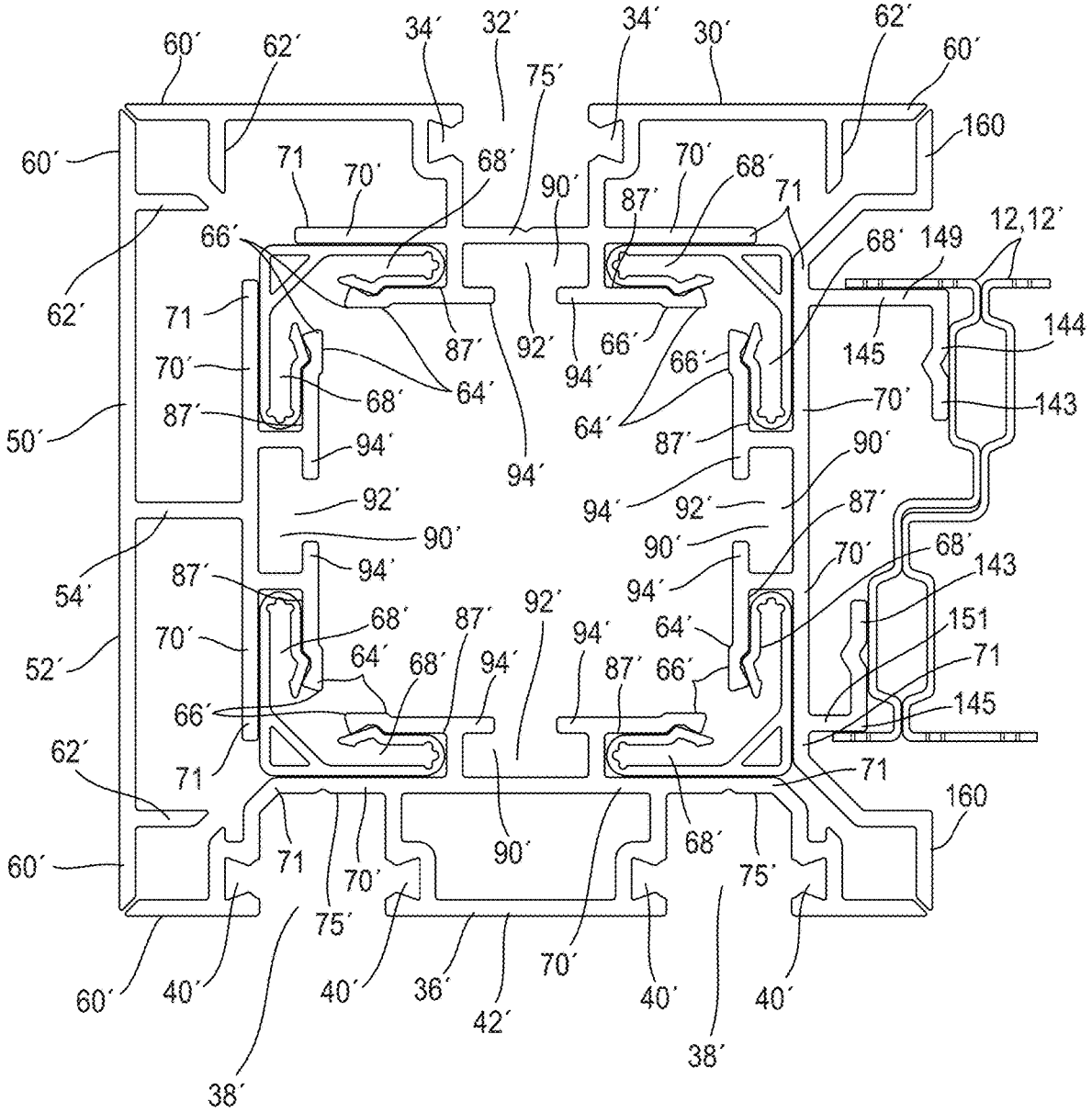

FIGS. 9-14 relate to a connector and system for establishing a corner junction where two wall sections meet at a corner in accordance with another embodiment of the present application. FIGS. 9 and 10 illustrate four corner junction between four different vertical members that may be included in the system. FIGS. 9 and 10 are for illustrative purposes to show how a corner can be made, and it should be understood often only two wall sections are involved in a corner junction.

At the top of FIG. 10, the vertical frame member 30' for a single pane glass panel wall section is shown, which has a central section with the mount in the form of a channel 32' for receiving a single glass panel (not shown). The channel 32' may also have smaller optional channels 34' for receiving a gasket (not shown) to seal the glass panel. At the left of FIG. 10 is the fascia trim member 50'. For example, the fascia trim member 50' may include a flat exterior wall 52', and optionally a supporting central web 54' for supporting the wall 52'.

At the bottom of FIG. 10, the vertical frame member 36' for a double pane glass panel wall section is shown, which has a central section with a mount in the form of two channels 38' each for a respective glass panel with two optional gasket channels 40' for receiving a gasket to seal the glass panels. An optional web 42' extends between the inner side walls of the two channels 38'.

As the fascia trim member 50', the vertical frame member 30', and the vertical frame member 36' have the same function and the same structure/construction as the fascia trim member 50, the vertical frame member 30, and the vertical frame member 36 in FIGS. 3-8 and as the structure/configuration and the function of the fascia trim member 50, the vertical frame member 30, and the vertical frame member 36 are described above in detail with respect to FIGS. 3-8, the structure/configuration and the function of the fascia trim member 50', the vertical frame member 30', and the vertical frame member 36' will not be described again in detail here.

Each vertical member 30', 36', 144, 50' also has inner walls 70', interlocking members 64', laterally extending legs 66', latch receiving spaces 68', and inner legs 62'. As the inner walls 70', the interlocking members 64', the laterally extending legs 66', the latch receiving spaces 68', and the inner legs 62' have the same function and the same structure/configuration as the inner walls 70, the interlocking members 64, the laterally extending legs 66, the latch receiving spaces 68, and the inner legs 62 in FIGS. 3-8 and as the structure/configuration and the function of the inner walls 70, the interlocking members 64, the laterally extending legs 66, the latch receiving spaces 68, and the inner legs 62 are described above in detail with respect to FIGS. 3-8, the structure/configuration and the function of the inner walls 70', the interlocking members 64', the laterally extending legs 66', the latch receiving spaces 68', and the inner legs 62' will not be described again in detail here.

As shown in FIGS. 3 and 10, the at least one of the mounts 32, 38 or 32', 38' for mounting the wall panel may be in the form of at least one channel 32, 38 or 32', 38' configured to receive a glass panel wall section therein. The at least one channel 32, 38 or 32', 38' may include smaller channels 34, 40 or 34', 40' that are configured to receive a gasket to seal the glass panel wall section.

For example, the vertical frame member 30 or 30' may include only one mount 32 or 32' in the form of a channel 32 or 32', while the vertical frame member 36 or 36' may include two mounts 38 or 38' in the form of channels 38 or 38'.

The at least one of the first vertical frame member and the second vertical frame member may include a central section with the mount 32 or 32' in the form of a channel 32 or 32' for mounting a single pane glass panel wall section as its wall panel. As shown in and described in detail below with respect to FIGS. 15-16, the mount 32 or 32' may be offset with respect to the central section of the respective vertical frame member. The mount 32 or 32' may include a gasket channel 34 or 34' for receiving a gasket to seal the glass panel wall section.

The at least one of the first vertical frame member and the second vertical frame member may include a central section with the mount in the form of two channels 38 or 38'. Each channel 38 or 38' for mounting a respective glass panel wall section to provide a double pane glass wall panel as its wall panel. The mount 38 or 38' may include two gasket channels 40 or 40' each for receiving a gasket to seal the glass panel wall sections.

The number of mounts/channels in the vertical frame member, the depth(s) of the mount(s)/channel(s) in the vertical frame member, and the widths(s) of the mount(s)/channel(s) in the vertical frame member may vary in other embodiments.

The at least one of the first vertical frame member and the second vertical frame member may be configured for a wall having its own internal frame with a vertical frame member, like the wall in FIG. 2, and any other wall having frame components creating an internal frame. The example at the right of FIGS. 3 and 10 show the frame member 44 or 144 including a main body 45 or 145 with a member 47 serving as the mount, which is of the same type or cross-section as the frame member 12, 12' (a stepped configuration) used for the internal frame of a wall section.

The frame member 44 or 144 can thus be connected to the end of a wall section using connections between the member 47 and the frame member 12, 12' in a manner similar to how the frame members of wall sections are connected at end to end junctions, with fasteners connecting member 47 (and thus in turn the frame member 44 or 144) to the frame member 12, 12' of the wall section. That establishes mounting of the panel to the frame member 44 or 144 indirectly through the panel's frame. For further details in this regard, reference may be made to U.S. Provisional Application Ser. No. 63/327,389, which is incorporated herein in its entirety for all purposes.

The main body 45 or 145 may include a longer supporting wall 49 or 149 and a shorter supporting wall 51 or 151 to support sections of the member 47. The member 45 or 145 also has a pair of flanges or legs 43 or 143 to which flanges on the member 47 is attached, such as by fasteners, including snap-fits, adhesive, nuts/bolts and the like. The attachment between the members 45/145 and 47 may be done prior to installation, such as at the manufacturing site, or may be done during installation. For example, the member 47 may be attached to the frame member 12, 12' of the wall section first, and then the member 45/145 is attached thereto.

The connector 76' includes the legs 82', the latches 84', the head 80', and the body structure 78'.

The legs 82' and the latches 84' have the same function and the same structure/configuration as the legs 82 and the latches 84 in FIG. 4 and as the structure/configuration and the function of the legs 82 and the latches 84 are described above in detail with respect to FIG. 4, the structure/configuration and the function of the legs 82' and the latches 84' will not be described again in detail here.

Figure 12:
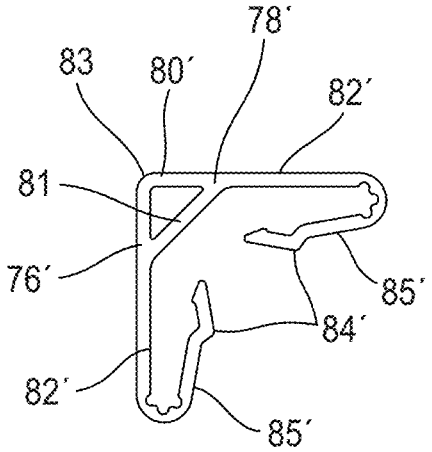
Figure 13:
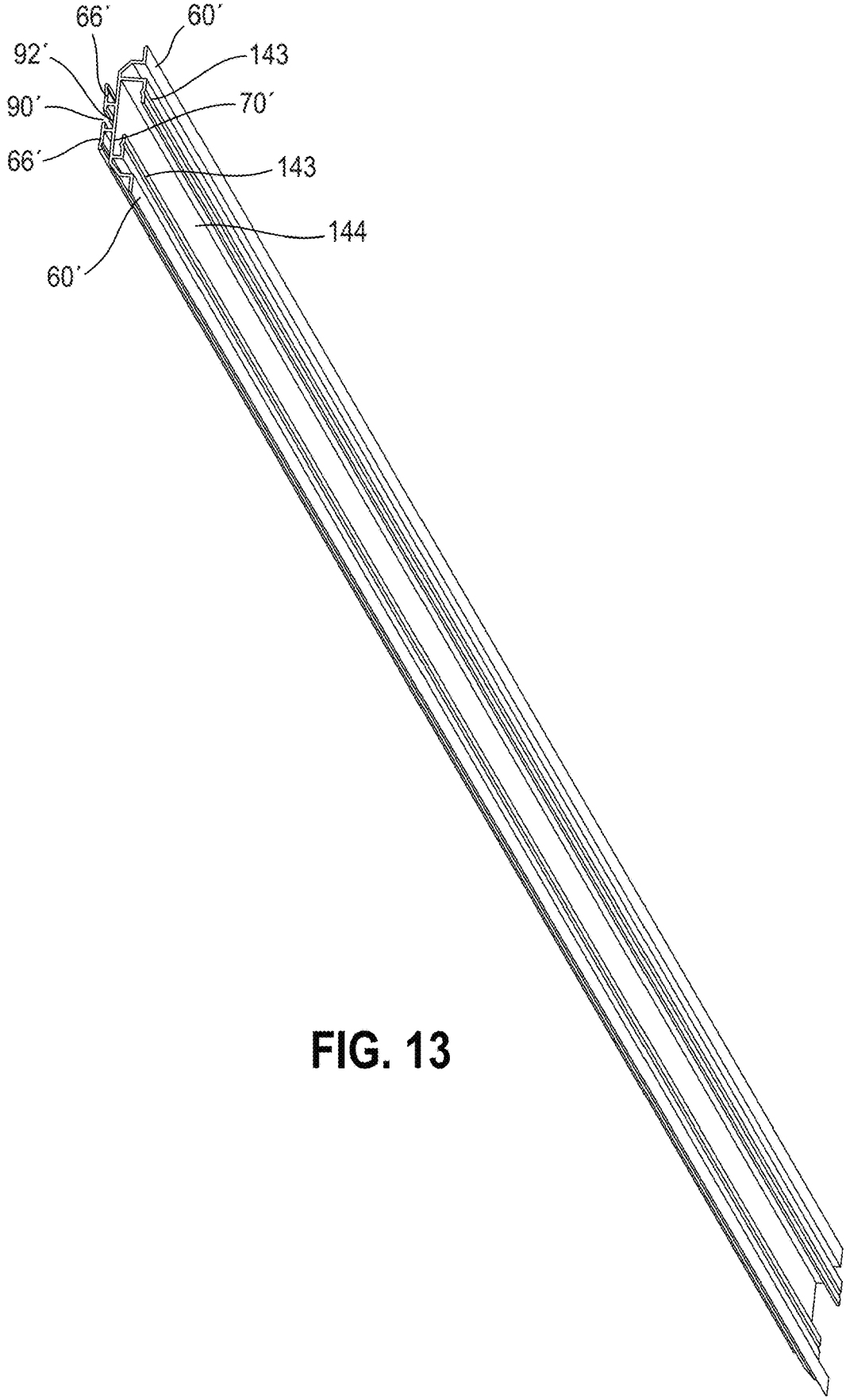
FIGS. 13 and 14 show a perspective view and a cross-section/an end view of one of the vertical frame member shown in FIGS. 9 and 10.
Figure 14:
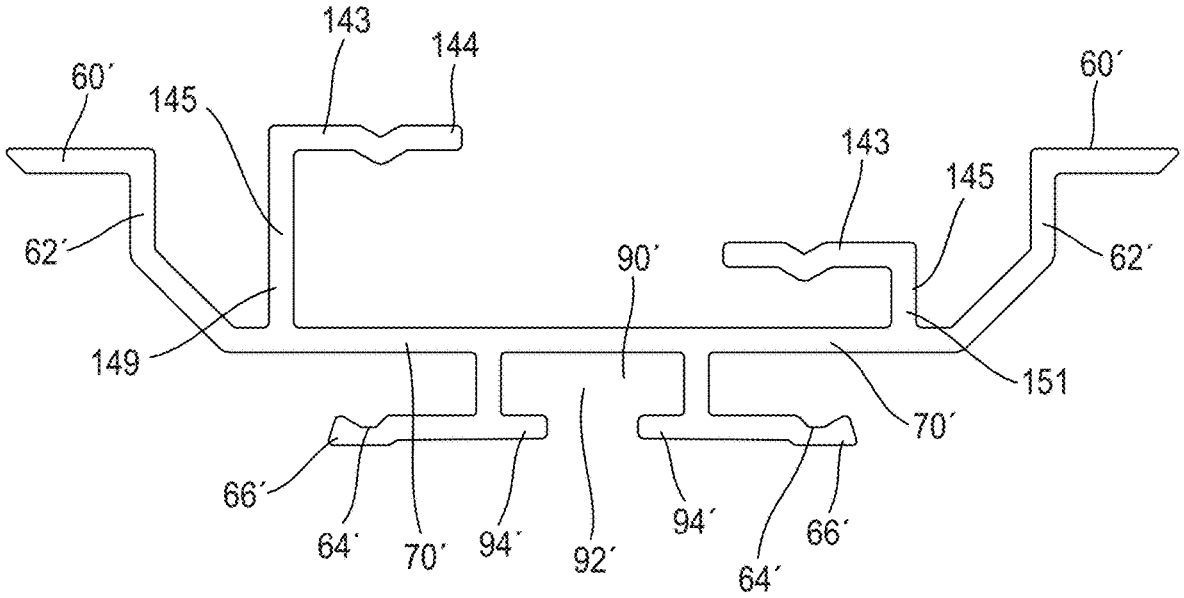

As shown in FIG. 12, the connector member 76' consists of the body structure 78' with the pair of legs 82' with the latches 84' and the head 80'. The head 80' includes a support bridge 81 extending between the legs 82' of the connector member 76'. The legs 82' may be connected to each other at an intersection 83 and may also be connected to each other via the support bridge 81. The head 80' of the body structure 78' of the connector member 76' that connects the pair of legs 82' may be a central web 81. The head 80' has a generally triangular configuration. The connector member 76' may be molded integral piece including the body structure 78' with the head 80' and the pair of legs 82' with the latches 84'. The head 80' of the connector member 76' connects the pair of legs 82' such that the legs 82' extend therefrom.

Referring to FIGS. 3 and 10, for each vertical frame member, the laterally extending leg 66 or 66' of each interlocking member 64 or 64' is spaced from the inner wall 70 or 70' of the vertical frame member 30, 36, 44, 50 or 30', 36', 144, 50' to define the laterally extending latch receiving spaces 68 or 68'. As shown in FIG. 10, the head 80' is configured to be received between free ends 71 of the inner walls 70' as the portions 70' support the corner junction relationship.

Referring to FIGS. 3 and 10, for each vertical frame member, the laterally extending legs 66 or 66' are spaced from the inner walls 70 or 70' of the respective vertical frame member and are connected thereto at one end and have an opposing end free for enabling insertion of the leg 82 or 82' with the latch 84 or 84' of the connector member 76 or 76' into the latch receiving space 68 or 68' of the respective vertical frame member. For each vertical frame member, the inner walls 70 or 70' share a common wall 75 or 75' extending laterally with respect to the frame member that is part of the mount 32, 38 or 32', 38'.

The laterally extending legs 66 or 66' include undulating configuration features, detent features, snap-fit features, press fit features and/or interference fit features on the surface inside the latch receiving space 68 or 68' of the vertical frame member. The features are used for the latching engagement to secure the vertical frame members in the corner junction relationship.

The legs 82 or 82' of the connector member 76 or 76' each includes a free leg that has resiliency with an outer surface 85 or 85' matching an inner surface 87 or 87' of the laterally extending leg 66 or 66' of the interlocking member 64 or 64' to create the latching engagement. The latches 84 or 84' of the connector member's legs 82 or 82' each includes undulating configuration features, detent features, snap-fit features, press fit features and/or interference fit features.

Referring to FIGS. 3 and 10, each vertical frame member has a pair of lateral legs 60 or 60' at the lateral edges thereof and a pair of inner legs 62 or 62' extending inwardly. The inner legs 62 or 62' may be spaced laterally away from the lateral edges.

Referring to FIG. 4, the head 80 of the body structure 78 of the connector member 76 is an outer head 800 extending therefrom opposite the pair of legs 82 with the latches 84. That is, the connector member 76 further comprises the outer head 800. The outer head 800 is configured to be received between the inner legs 62 and the lateral legs 60 of the vertical frame members as the portions to support the corner junction relationship. Referring to FIG. 4, the connector member 76 is a molded integral piece including the body structure 78 with the head 80 and the outer head 800, and the pair of legs 82 with the latches 84. The outer head 800 of the connector member 76 helps support the corner junction relationship by maintaining proper distance between the lateral leg 66 of each vertical frame member and the opposing inner leg 62 of the other vertical frame member, which also helps prevent the lateral leg 66 from being deformed inwardly in the event it receives force against it after modular wall is erected.

As shown in FIGS. 3 and 10, for each vertical frame member, each laterally extending leg 66 or 66' of the interlocking members 64 or 64' is positioned inwardly of the associated inner leg 62 or 62' so that the insertion of the leg 82 or 82' with the latch 84 or 84' of the connector member 76 or 76' into the latch receiving space 68 or 68' of the vertical frame member takes place without interference from the inner leg 62 or 62'.

Figure 11:
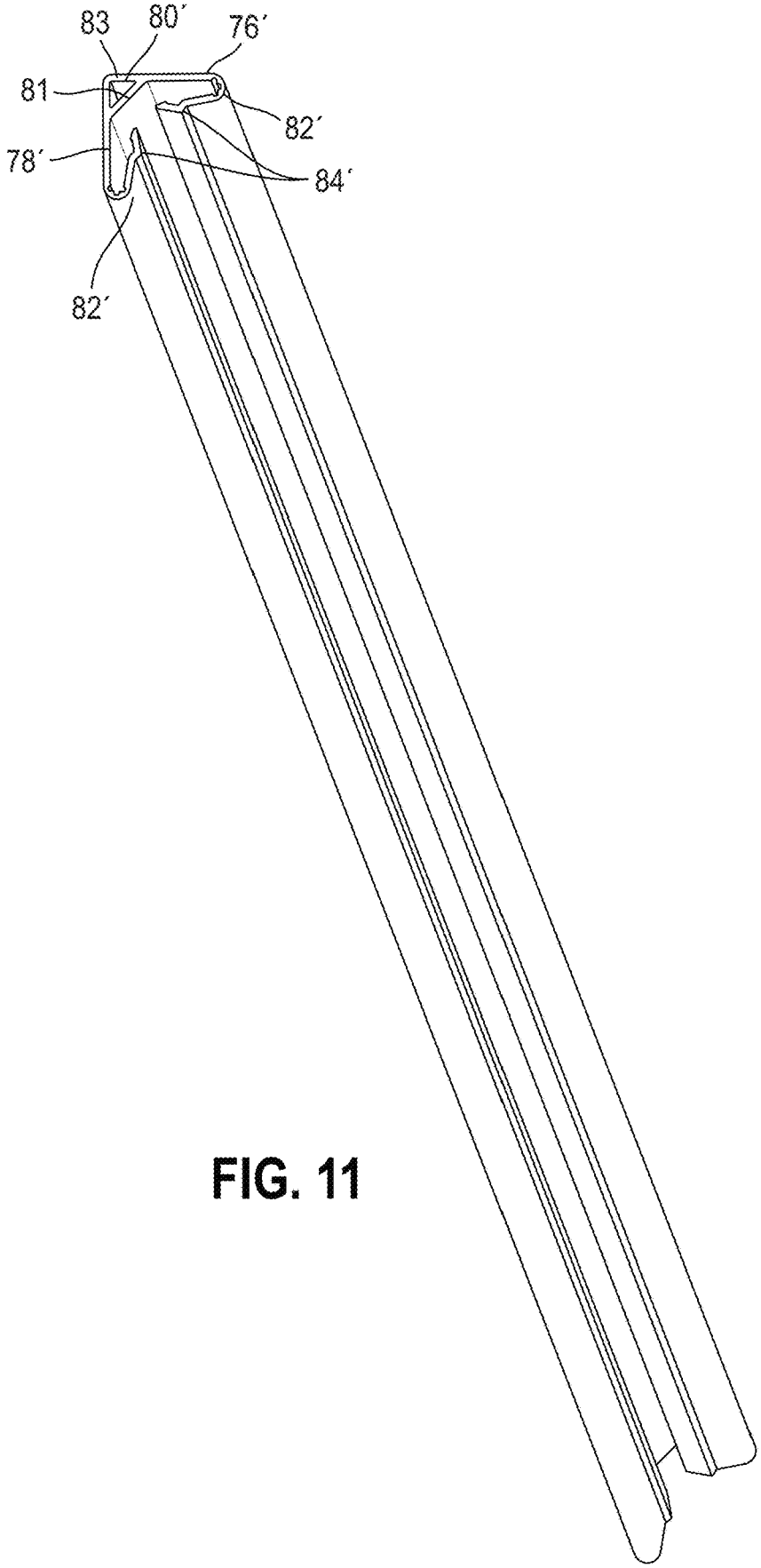
FIGS. 11 and 12 illustrate a perspective view and an end/a cross-section view, respectively, of a connector member shown in FIGS. 9 and 10.

In FIG. 11, the clip may run full length. This may help in blocking light from passing through the joints. In another embodiment, the clip may have smaller lengths (instead of full length) so the clip can be adjusted for ease of assembly and disassembly.

Figure 15:
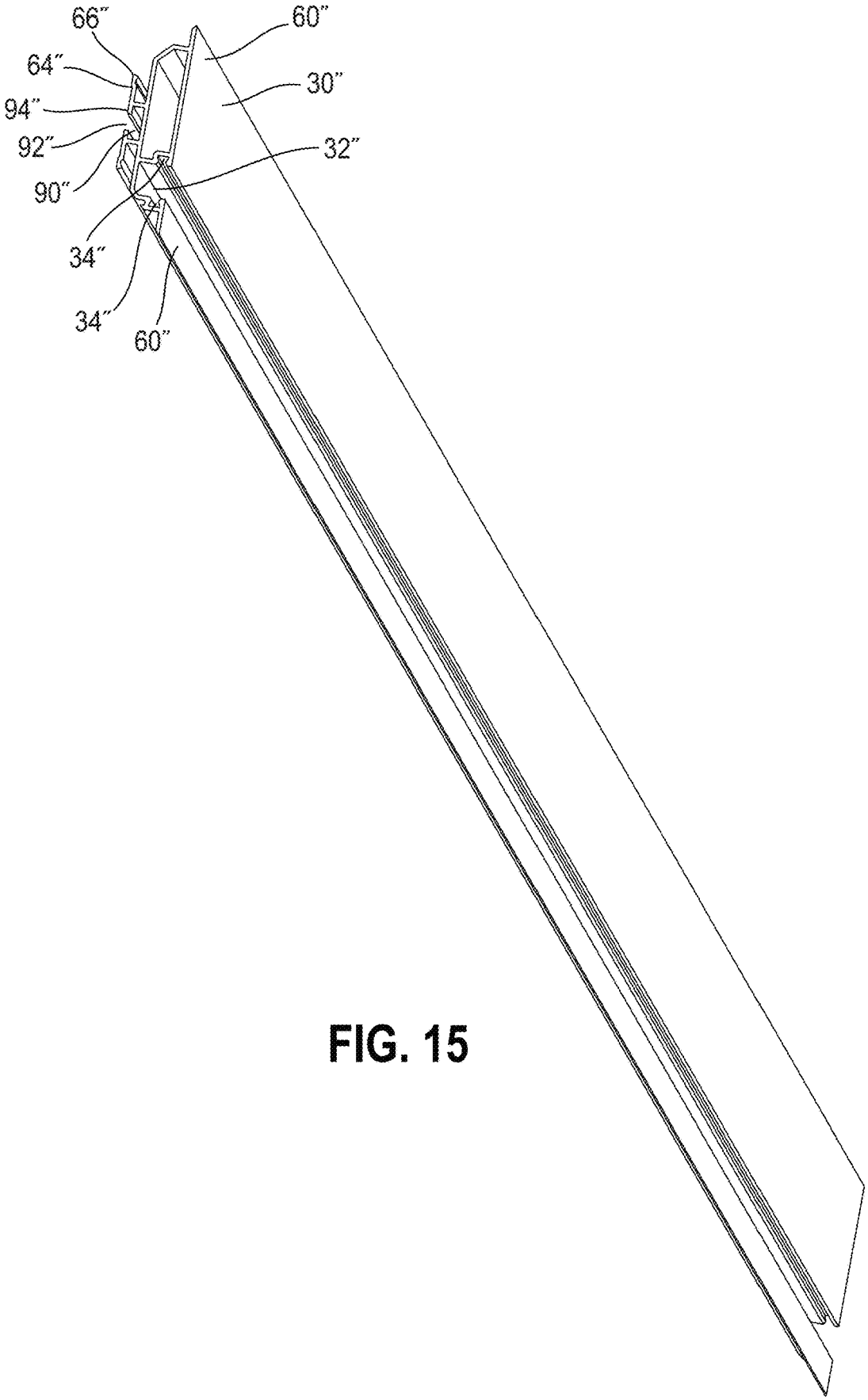
FIGS. 15 and 16 show a perspective view and a cross-section/an end view of a vertical frame member in accordance with another embodiment of the present patent application.
Figure 16:
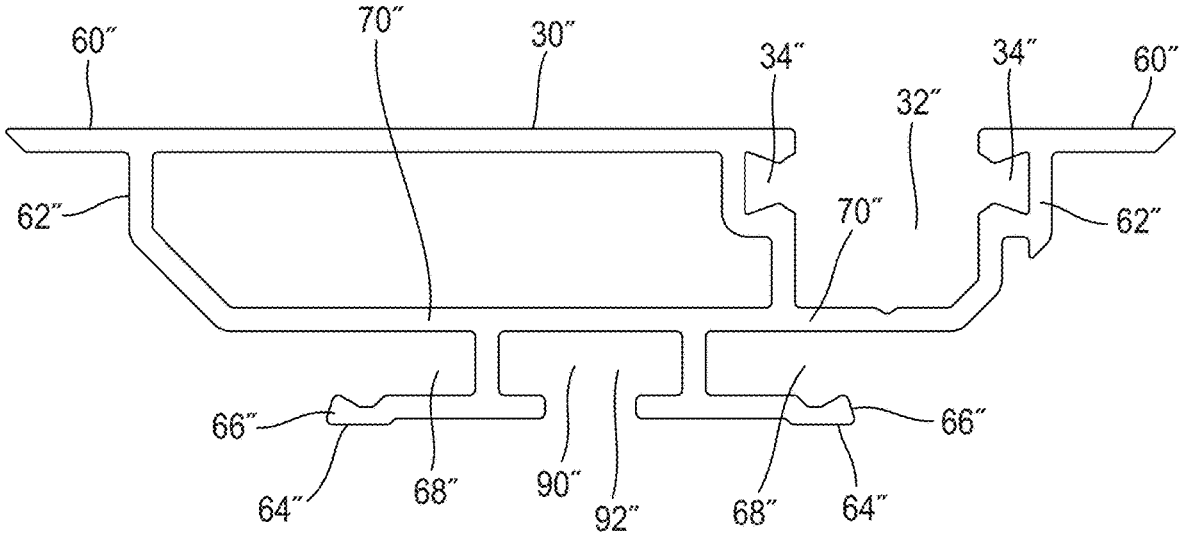

In another embodiment, a vertical frame member 30" for a single pane glass panel wall section is shown in FIGS. 15-16. The vertical frame member 30" may be interchangeable with the vertical frame member 30' in FIG. 10. The vertical frame member 30" includes an offset section (e.g., offset from a central section of the vertical frame member 30") with a mount 32" in the form of a channel 32" for receiving a single glass panel (not shown). The channel 32" may also have smaller optional channels 34" for receiving a gasket (not shown) to seal the glass panel.

Although the channel 32" is shown in FIG. 16 to be on the right side of the vertical frame member 30", in another embodiment, the channel 32" may be disposed on the other/left side of the vertical frame member 30". The configuration of the vertical frame member 30" with the offset channel 32" facilitates the single pane glass panel wall section to be positioned at the outer edge or an inner edge of the corner joint/vertical frame member 30" (i.e., instead of in the center section of the corner joint/vertical frame member 30").

Referring to FIG. 16, the inner legs 62" of the vertical frame member 30" may be integrally formed with the inner walls 70' of the vertical frame member 30".

Although the present patent application has been described in detail for the purpose of illustration, it is to be understood that such detail is solely for that purpose and that the present patent application is not limited to the disclosed embodiments, but, on the contrary, is intended to cover modifications and equivalent arrangements that are within the spirit and scope of the appended claims. In addition, it is to be understood that the present patent application contemplates that, to the extent possible, one or more features of any embodiment can be combined with one or more features of any other embodiment.

The illustration of the embodiments of the present patent application should not be taken as restrictive in any way since a myriad of configurations and methods utilizing the present patent application can be realized from what has been disclosed or revealed in the present patent application. The systems, features and embodiments described in the present patent application should not be considered as limiting in any way. The illustrations are representative of possible construction and mechanical embodiments and methods to obtain the desired features. The location and/or the form of any minor design detail or the material specified in the present patent application can be changed and doing so will not be considered new material since the present patent application covers those executions in the broadest form.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Terms of degree such as "generally," "substantially," "approximately," and "about" may be used herein when describing the relative positions, sizes, dimensions, or values of various elements, components, regions, layers and/or sections. These terms mean that such relative positions, sizes, dimensions, or values are within the defined range or comparison (e.g., equal or close to equal) with sufficient precision as would be understood by one of ordinary skill in the art in the context of the various elements, components, regions, layers and/or sections being described.

The foregoing illustrated embodiments have been provided to illustrate the structural and functional principles of the present patent application and are not intended to be limiting. To the contrary, the present patent application is intended to encompass all modifications, alterations and substitutions within the spirit and scope of the appended claims.

What is claimed:

1. A system for interconnecting modular wall vertical frame members meeting at a corner junction, the system comprising:

a first vertical frame member;

a second vertical frame member;

each of the first and second vertical frame members having a mount for mounting a wall panel;

each of the first and second vertical frame members having lateral edges;

each of the first and second vertical frame members having a pair of lateral legs at the lateral edges thereof;

each of the first and second vertical frame members having a pair of interlocking members positioned inwardly of the mount, the pair of interlocking members each having a laterally extending leg defining a laterally extending latch receiving space;

a connector member having a body structure with a pair of legs with latches thereon extending therefrom, the pair of legs with the latches extending to form a general V-shape;

wherein the pair of legs with the latches are configured to be received in the latch receiving spaces of the first and second vertical frame members in a latching engagement to secure the first and second vertical frame members in a corner junction relationship;

wherein the body structure of the connector member includes a head configured to be received between portions of the first and second vertical frame members to support the corner junction relationship; and wherein, in each of the first and second vertical frame members, the laterally extending legs of the pair of interlocking members are substantially parallel to the pair of lateral legs.

2. The system of claim 1, wherein, for each of the first and second vertical frame members, the laterally extending leg of each of the interlocking members thereof is spaced from an inner wall of an associated one of the first and second vertical frame members to define the laterally extending latch receiving spaces thereof, and wherein the head of the connector member connects the pair of legs such that the pair of legs extend therefrom and the head is configured to be received between free ends of the inner walls as said portions of the first and second vertical frame members to support the corner junction relationship.

3. The system of claim 2, wherein said head includes a support bridge extending between said legs with the latches of the connector member.

4. The system of claim 3, wherein said head has a generally triangular configuration.

5. The system of claim 2, wherein, for each of the first and second vertical frame members, the laterally extending legs are spaced from the inner walls of a respective one of the vertical frame members and are each connected thereto at one end thereof and each have an opposing end free for enabling insertion of the leg with the latch of the connector member into the latch receiving space of the respective one of the vertical frame members.

6. The system of claim 5, wherein, for each of the first and second vertical frame members, the inner walls share a common wall extending laterally with respect to the frame member that is part of said mount.

7. The system of claim 2, wherein each of the first and second vertical frame members has a pair of lateral legs at the lateral edges thereof and a pair of inner legs extending inwardly, the inner legs being spaced laterally away from the lateral edges;

wherein the head of the body structure of the connector member that connects the pair of legs is a central web, and the connector member further comprises an outer head extending therefrom opposite the pair of legs with the latches, and wherein the outer head is configured to be received between the inner legs and lateral legs of the first and second vertical frame members as further said portions of the first and second vertical frame members to additionally support the corner junction relationship.

8. The system of claim 7, wherein at least one of the mounts for mounting the wall panel comprises at least one channel configured to receive a glass panel wall section therein, and wherein the at least one channel includes additional channels that are configured to receive a gasket to seal the glass panel wall section, the additional channels being smaller than the at least one channel configured to receive a glass panel wall section therein.

9. The system of claim 7, wherein at least one of the first vertical frame member and the second vertical frame member includes a central section with the mount comprising a channel for mounting a single pane glass panel wall section as said wall panel, and wherein the mount includes a gasket channel for receiving a gasket to seal the glass panel wall section.

10. The system of claim 7, wherein at least one of the first vertical frame member and the second vertical frame member includes a central section with the mount comprising two channels, each of the two channels for mounting a respective glass panel wall section to provide a double pane glass wall panel as said wall panel, and wherein the mount includes two gasket channels each for receiving a gasket to seal the glass panel wall sections.

11. The system of claim 7, wherein at least one of the first vertical frame member and the second vertical frame member (a) is configured for a wall having an internal frame with a vertical frame member and (b) includes a main body with a member serving as the mount, and wherein the main body includes a first supporting wall and a second supporting wall to support sections of the member, the first supporting wall being longer than the second supporting wall.

12. The system of claim 7, wherein, for each of the first and second vertical frame members, the laterally extending legs are spaced from the inner walls of the respective vertical frame member and are connected thereto at one end and have an opposing end free for enabling insertion of the leg with the latch of the connector member into the latch receiving space of the respective vertical frame member, and wherein, for each of the first and second vertical frame members, each laterally extending leg of the pair of interlocking members is positioned inwardly of an adjacent one of the pair of inner legs so that the insertion of the leg with the latch of the connector member into the latch receiving space of the vertical frame member takes place without interference from the adjacent one of the pair of inner legs.

13. The system of claim 12, wherein, for each of the first and second vertical frame members, the inner walls share a common wall extending laterally with respect to the frame member that is part of said mount.

14. The system of claim 7, wherein the laterally extending legs includes at least one of the group consisting of an undulating portion, a detent, a snap-fit portion, a press fit features and an interference fit portion inside the latch receiving space of the vertical frame member.

15. The system of claim 7, wherein the pair of legs of the connector member each includes a resilient free leg with an outer surface matching an inner surface of the laterally extending leg of the interlocking member to create the latching engagement, and wherein the latches of the legs of the connector member each includes undulating configuration features, detent features, snap-fit features, press fit features and/or interference fit features.

16. The system of claim 7, wherein the connector member is a molded integral piece including the body structure with the head and the outer head, and the pair of legs with the latches.

17. The system of claim 7, wherein the outer head of the connector member helps support the corner junction relationship by maintaining a predetermined distance between one of the pair of lateral legs of each of the first and second vertical frame members and one of the pair of opposing inner legs of the other of the first and second vertical frame members, which also helps prevent the lateral leg from being deformed inwardly in the event the lateral leg receives force after modular wall is erected.

18. The system of claim 1, wherein the connector member consists of the body structure with the pair of legs with the latches and the head.

19. The system of claim 1, wherein at least one of the mounts for mounting the wall panel comprises at least one channel configured to receive a glass panel wall section therein, and wherein the at least one channel includes additional channels that are configured to receive a gasket to seal the glass panel wall section, the additional channels each being smaller than the at least one channel configured to receive a glass panel wall section therein.

20. The system of claim 1, wherein at least one of the first vertical frame member and the second vertical frame member includes a central section with the mount comprising a channel for mounting a single pane glass panel wall section as said wall panel, and wherein the mount includes a gasket channel for receiving a gasket to seal the glass panel wall section.

21. The system of claim 1, wherein at least one of the first vertical frame member and the second vertical frame member includes a central section with the mount comprising two channels, each of the two channels for mounting a respective glass panel wall section to provide a double pane glass wall panel as said wall panel, and wherein the mount includes two gasket channels each for receiving a gasket to seal the glass panel wall sections.

22. The system of claim 1, wherein at least one of the first vertical frame member and the second vertical frame member (a) is configured for a wall having an internal frame with a vertical frame member and (b) includes a main body with a member serving as the mount, and wherein the main body includes a first supporting wall and a second supporting wall to support sections of the member, the first supporting wall being longer than the second supporting wall.

23. The system of claim 1, wherein the laterally extending legs includes at least one of the group consisting of an undulating portion, a detent, a snap-fit portion, a press fit portion and an interference fit portion on the surface inside the latch receiving space of the vertical frame member.

24. The system of claim 1, wherein the pair of legs of the connector member each includes a resilient free leg with an outer surface matching an inner surface of the laterally extending leg of the interlocking member to create the latching engagement, and wherein the latches of the legs of the connector member each includes at least one of the group consisting of an undulating portion, a detent, a snap-fit portion, a press fit portion and an interference fit portion.

25. The system of claim 1, wherein the connector member is a molded integral piece including the body structure with the head and the pair of legs with the latches.

26. The system of claim 1 wherein each of the first and second vertical frame members has a pair of lateral legs at the lateral edges thereof and a pair of inner legs extending inwardly, the inner legs being spaced laterally away from the lateral edges, wherein the head of the body structure of the connector member is an outer head extending therefrom opposite the pair of legs with the latches, and wherein the outer head is configured to be received between the inner legs and lateral legs of the first and second vertical frame members as said portions of said first and second vertical frame members to support the corner junction relationship.

27. A system for interconnecting modular wall vertical frame members meeting at a corner junction, the system comprising:

a first vertical frame member;

a second vertical frame member;

each of the first and second vertical frame members having a mount for mounting a wall panel;

each of the first and second vertical frame members having a pair of interlocking members positioned inwardly of the mount, the pair of interlocking members each having a laterally extending leg defining a laterally extending latch receiving space;

a connector member having a body structure with a pair of legs with latches thereon extending therefrom, the pair of legs with the latches extending to form a general V-shape;

wherein the pair of legs with the latches are configured to be received in the latch receiving spaces of the first and second vertical frame members in a latching engagement to secure the first and second vertical frame members in a corner junction relationship;

wherein the body structure of the connector member includes a head configured to be received between portions of the first and second vertical frame members to support the corner junction relationship;

wherein in each of the first and second vertical frame members a lateral direction in which said pair of laterally extending legs thereof and said lateral extending latch receiving spaces thereof extends is also a direction of a thickness of the wall panel to be mounted to said mount thereof.

28. A system for interconnecting modular wall vertical frame members meeting at a corner junction, the system comprising:

a first vertical frame member;

a second vertical frame member;

each of the first and second vertical frame members having a mount for mounting a wall panel;

each of the first and second vertical frame members having a pair of interlocking members positioned inwardly of the mount, the pair of interlocking members each having a laterally extending leg defining a laterally extending latch receiving space;

a connector member having a body structure with a pair of legs with latches thereon extending therefrom, the pair of legs with the latches extending to form a general V-shape;

wherein the pair of legs with the latches are configured to be received in the latch receiving spaces of the first and second vertical frame members in a latching engagement to secure the first and second vertical frame members in a corner junction relationship;

wherein the body structure of the connector member includes a head configured to be received between portions of the first and second vertical frame members to support the corner junction relationship;

wherein in each of the first and second vertical frame members the pair of laterally extending legs thereof extend in opposing directions away from one another with said latch receiving spaces opening laterally in said opposing directions.

* * * * *